US007140795B2

(12) United States Patent
Shiraishi et al.

(10) Patent No.: US 7,140,795 B2
(45) Date of Patent: Nov. 28, 2006

(54) PRINTER

(75) Inventors: Atsushi Shiraishi, Kanagawa (JP); Tomohiro Maekawa, Kanagawa (JP); Masatoshi Mikuriya, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/536,070

(22) PCT Filed: Nov. 28, 2003

(86) PCT No.: PCT/JP03/15233

§ 371 (c)(1),
(2), (4) Date: May 24, 2005

(87) PCT Pub. No.: WO2004/050519

PCT Pub. Date: Jun. 17, 2004

(65) Prior Publication Data

US 2006/0056901 A1 Mar. 16, 2006

(30) Foreign Application Priority Data

Nov. 29, 2002 (JP) ..... 2002-349208

(51) Int. Cl.
*B41J 11/58* (2006.01)

(52) U.S. Cl. ..... 400/624; 400/625; 399/693; 271/9.08; 271/9.09; 271/145

(58) Field of Classification Search ..... 399/391, 399/393; 400/624, 622, 625, 693; 271/145, 271/147, 9.08, 9.09
See application file for complete search history.

(56) References Cited

U.S. PATENT DOCUMENTS

| | | | | |
|---|---|---|---|---|
| 5,287,164 | A * | 2/1994 | Watanabe | 399/391 |
| 6,217,019 | B1 * | 4/2001 | Ishiduka et al. | 271/147 |
| 6,561,506 | B1 * | 5/2003 | Sasaki et al. | 271/145 |

FOREIGN PATENT DOCUMENTS

| | | |
|---|---|---|
| JP | 63-48660 | 10/1989 |
| JP | 04-148732 | 5/1992 |
| JP | 09-309631 | 12/1997 |
| JP | 2002-128287 | 5/2002 |

* cited by examiner

*Primary Examiner*—Minh Chau
(74) *Attorney, Agent, or Firm*—Sonnenschein Nath & Rosenthal LLP

(57) ABSTRACT

The printer can improve the workability of storing and ejecting printing sheets in or from a storage tray. The printer includes a storage tray comprising a sheet storage case for storing a stack of a plurality of printing sheets with at least one of the sides of the storage case being opened and a cover for covering the sheet storage case, wherein the cover comprises a cover body and an moveable member supported by the cover body for freely opening and closing the opening of the sheet storage case. When the entire storage tray is disposed in the slot of the chassis, a pick-up block ejects one printing sheet at a time, and when a part of the storage tray is pulled out of the slot of the chassis, the moveable member can be opened or closed and the printing sheet can be stored in or discharged from the sheet storage case.

1 Claim, 47 Drawing Sheets

PRINTER

TECHNICAL FIELD

The present invention relates to a printer.

BACKGROUND ART

There are known printers that print on printing sheets such as printing paper or printing film by thermal transfer or laser. Usually, such known printers include a sheet storing block for storing a plurality of printing sheets in layers, a pick-up block for ejecting one of the printing sheets stored in the sheet storing block, a delivery block for delivering the printing sheet ejected from the pick-up block, a printing block for printing an image on the printing sheet delivered by the delivery block, and a discharge block for discharging the printing sheet on which an image was printed on at the printing block. Each block is disposed inside a chassis.

Such known printers may be a so-called horizontal type wherein a printing sheet is delivered from the storing block to the sheet discharge block so that the surface of the printing sheet faces the vertical direction or may be a dual-purpose type wherein the printing sheet is disposed horizontally or the printing sheet is disposed vertically so that the printing sheet is delivered from the sheet storing block to the discharge block as it faces the horizontal direction.

The dual-purpose type printer may be disposed according to the width of the installation location. In this way, the installation location of the printer may be flexibly selected, and the usability of the printer is improved.

Since the dual-purpose type printer may be disposed vertically, the installation area required for disposing the printer may be decreased. In particular, for computed tomography performed in a hospital, the printer may be adjoined to the tomographic apparatus or to a computer disposed in a medical examination room since a large installation area is not required. Hence, medical service may be speeded up and simplified.

For such a printer, a storage tray is disposed in the sheet storage block for storing printing sheets. The storage tray is disposed inside a slot on the chassis.

The storage tray may include a sheet storage case, which is a planular box with an opening for storing sheets, and a cover, which is for covering the opening of the sheet storage case (e.g., Japanese Unexamined Patent Application Publication No. 10-101258). The cover is disposed to prevent the printing sheets from falling out of the sheet storage case. In particular, for a vertically disposed printer, a cover is required since the printing sheets can easily fall out of the sheet storage case.

When the storage tray including the printing sheets is disposed and fixed into the slot, the pick-up block ejects one of the printing sheets from the storage tray and the delivery block delivers the sheet to the printing block.

Printing sheets are ejected from or placed in the storage tray while the storage tray is pulled out of the slot.

As described above, to eject or insert a printing sheet from/into the storage tray of a known printer, the storage tray must be pulled out of the slot of the chassis and then the cover must be removed. The procedure for discharging or inserting a sheet of printing paper from or to the storage tray is troublesome and inefficient.

Moreover, once the storage tray is completely pulled out of the slot, it is difficult to put it back; thus, usability is low.

To store the printing sheets while the storage tray is completely pulled out of the chassis, the storage tray must be strong enough to support the weight of the printing sheets to be stored in the storage tray. For this reason, reinforcements might have to be disposed on the storage tray or the thickness of the components might have to be increased for reinforcement.

DISCLOSURE OF INVENTION

An object of the printer according to the present invention is to solve the above-mentioned problems and to improve the workability of storing and discharging printing sheets to or from a storage tray.

To achieve the above-mentioned object, the printer according to the present invention includes a storage tray comprising a sheet storage case for storing a stack of a plurality of printing sheets with at least one of the sides of the storage case being opened and a cover for covering the sheet storage case, wherein the cover comprises a cover body and an moveable member supported by the cover body for freely opening and closing the opening of the sheet storage case. When the entire storage tray is disposed in the slot of the chassis, a pick-up block ejects one printing sheet at a time, and when a part of the storage tray is pulled out of the slot of the chassis, the moveable member can be opened or closed and the printing sheet can be stored in or discharged from the sheet storage case.

Consequently, the printer according to the present invention enables storage and ejection of the printing sheet in or from the storage tray when a part of the storage tray is pulled out of the chassis.

Since the entire storage tray does not have to be pulled out of the slot, the storage tray can be disposed in the slot quickly and easily.

Moreover, since the printing sheets can be stored in or ejected from the sheet storage case when a part of the storage tray is disposed inside the chassis, both the storage tray and the chassis bears the weight of the printing sheets. Thus, measures such as adding reinforcements to the storage tray and thickening the components of the storage tray for reinforcement do not have to be taken.

In the printer having the above-mentioned structure, a locking groove having a releasing engagement portion and a stopping engagement portion is formed on the sheet storage case, and locking protrusions are formed on the moveable member of the cover. When the moveable member is opened, the locking protrusions are engaged with the releasing engagement portion to lock the moveable member to the cover-open position. When the moveable member is closed, the locking protrusions are engaged with the stopping engagement portion to lock the moveable member to the cover-closed position. In this way, the storage and discharge of the printing sheet in or from the storage tray can be carried out smoothly and the printing sheets can be reliably prevented from falling out.

BEST MODE FOR CARRYING OUT THE INVENTION

Figure 1:
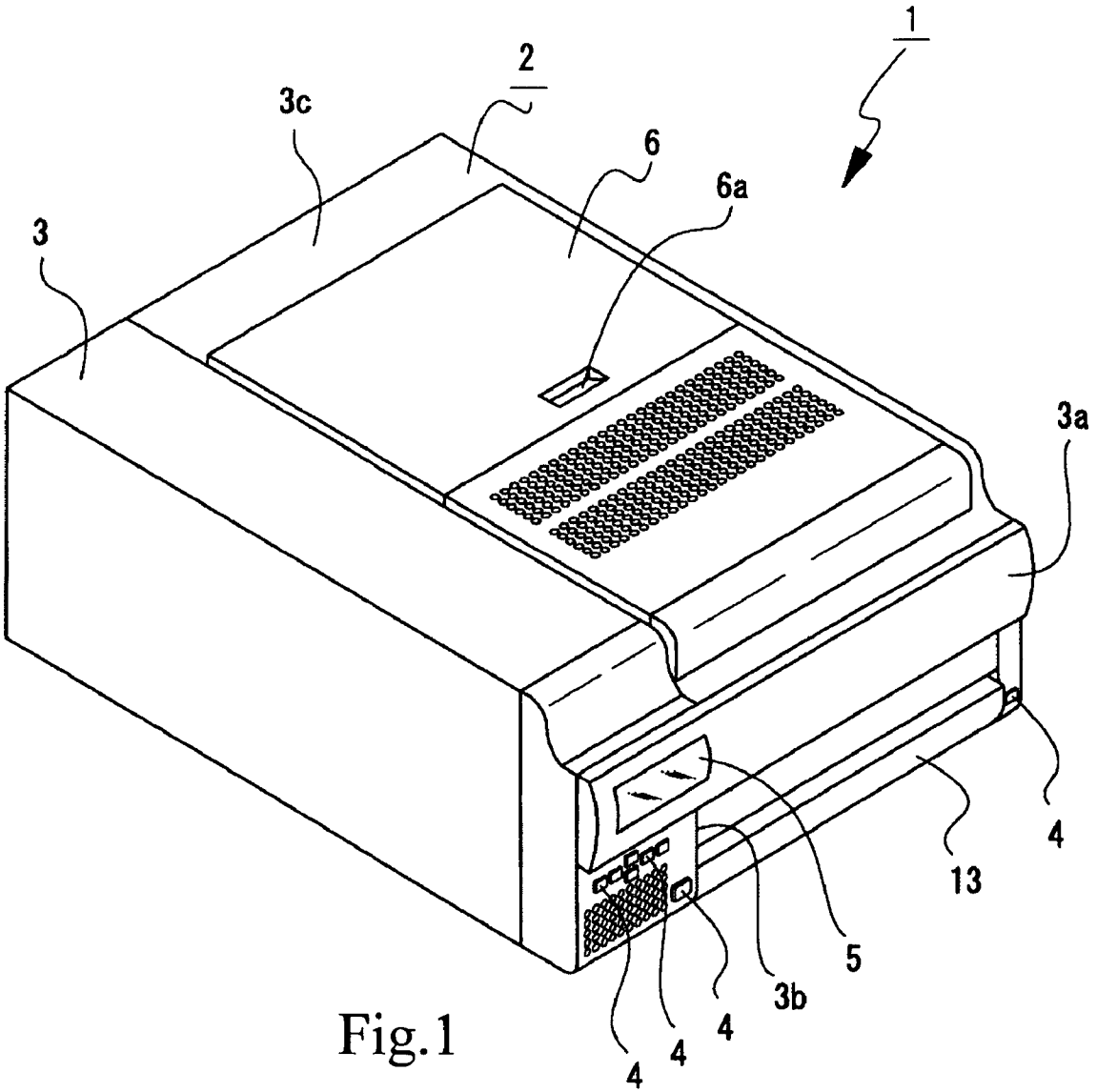
FIG. 1, together with FIGS. 2 to 47, illustrates an embodiment of a printer according to the present invention and a schematic perspective view of a printer disposed horizontally.

An embodiment of a printer according to the present invention will be described below by referring to the drawings.

An embodiment of a printer according to the present invention, described below, is a thermal head printer including a thermal head for printing image data, which is, for example, acquired through computed tomography performed in a hospital, on a printing film (printing sheet) by thermal transfer.

Figure 2:
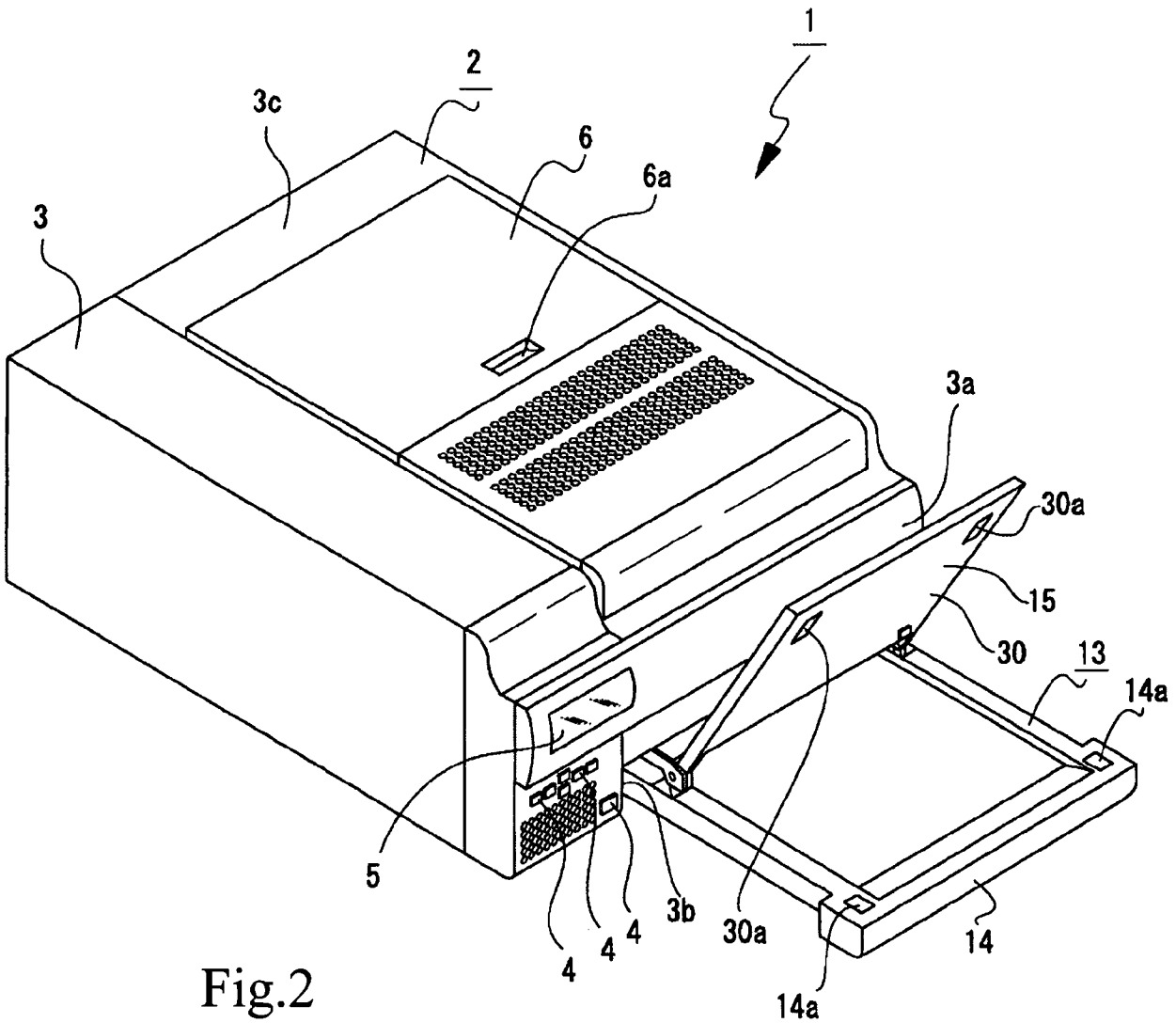
FIG. 2 is a schematic perspective view of the printer disposed horizontally and having a part of the storage tray pulled out.
Figure 3:
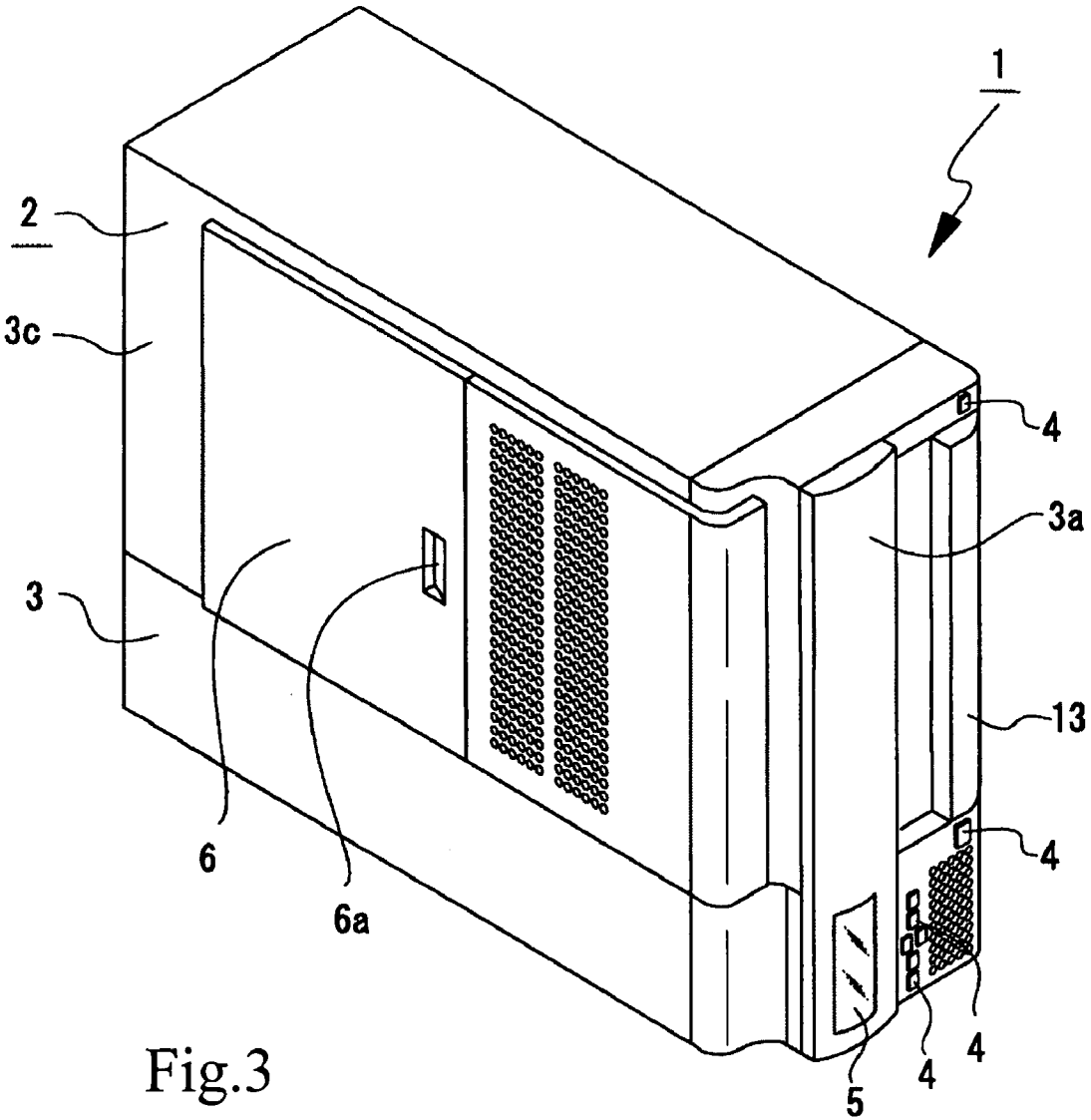
FIG. 3 is a schematic perspective view of the printer disposed vertically.
Figure 4:
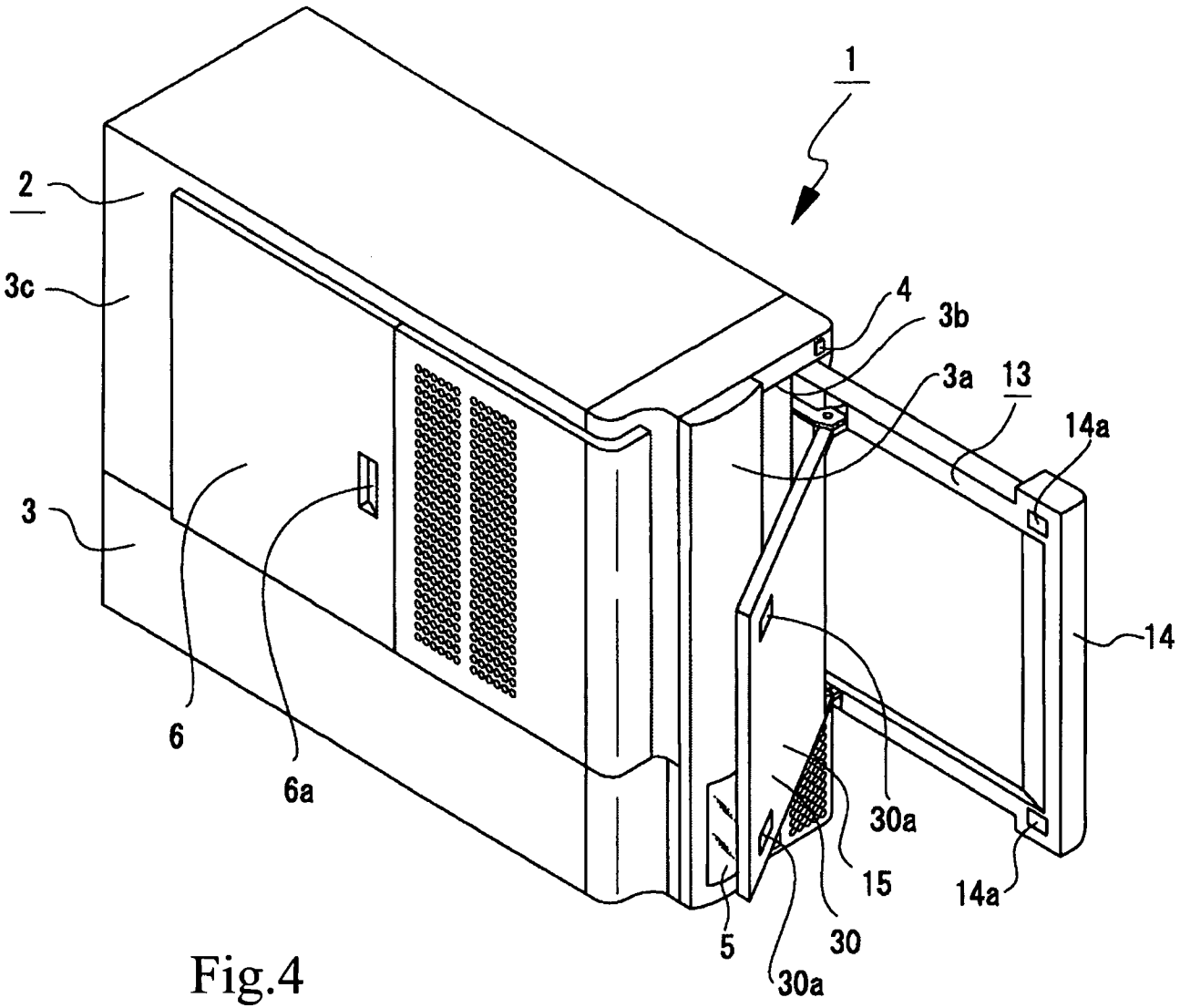
FIG. 4 is a schematic perspective view of the printer disposed vertically with a part of the storage tray pulled out.

A printer 1 is a dual-purpose type printer that can be disposed in a horizontal arrangement in which the surface of a printing sheet faces the vertical direction while the printing sheet is delivered (refer to FIGS. 1 and 2) or a vertical arrangement in which the surface of a printing sheet faces the horizontal direction while the printing sheet is delivered (refer to FIGS. 3 and 4). In the description below, the printer 1 is disposed in the vertical arrangement.

Figure 5:
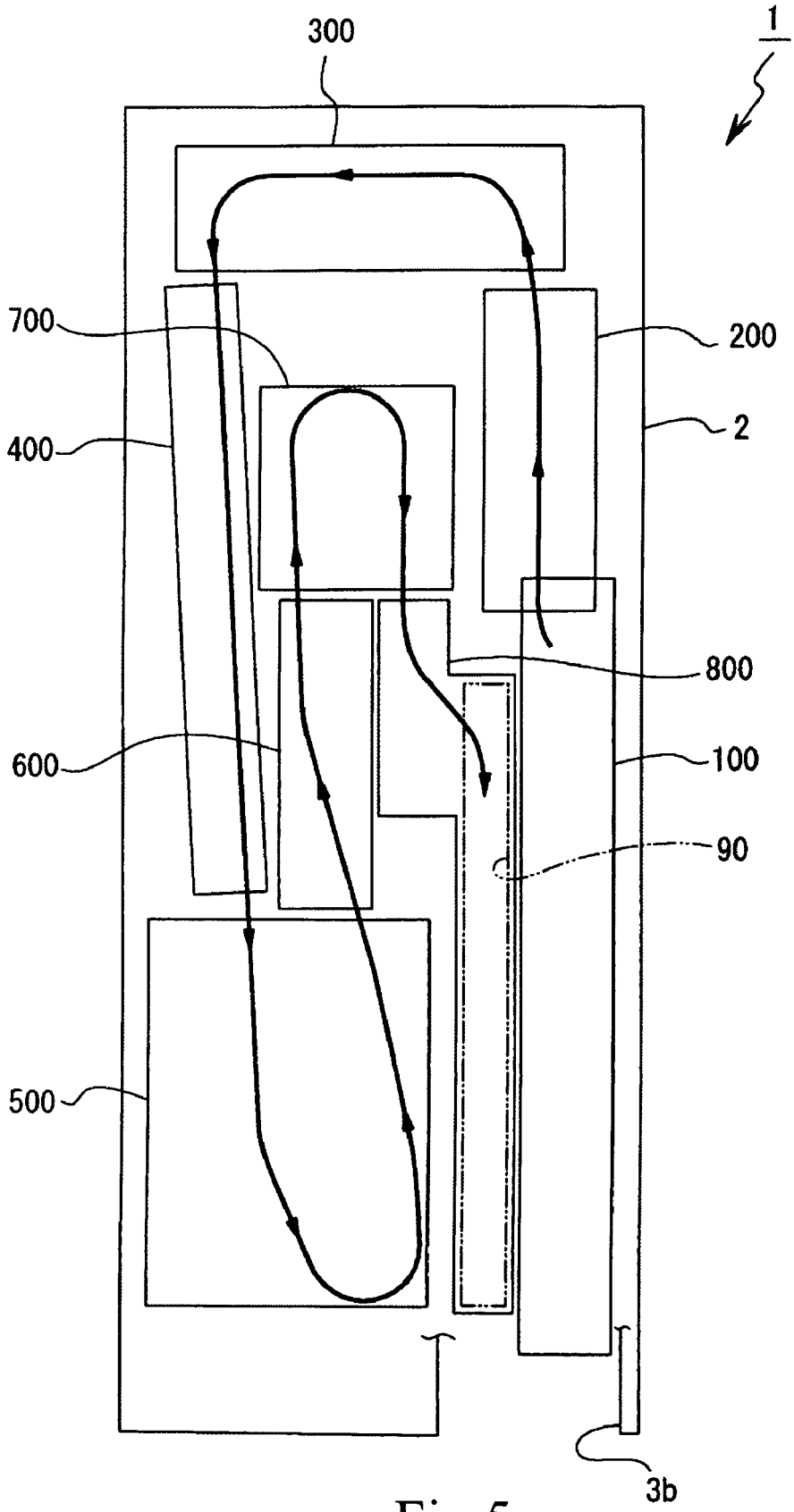
FIG. 5 is a schematic plan view of each block included in the printer and the delivery path of the printing sheet.

As illustrated in FIG. 5, a chassis 2 of the printer 1 includes a sheet storage block 100, a pick-up block 200, a delivery block 300, a positioning block 400, a printing block 500, an intermediate delivery block 600, a density measurement block 700, and a sheet discharge block 800.

In printer 1, as illustrated in FIG. 5, the sheet storage block 100 ejects printing sheets 3000 from the pick-up block 200. Then, the printing sheet 3000 is sent through the delivery block 300, the positioning block 400, the printing block 500, the intermediate delivery block 600, and the density measurement block 700 and finally to the sheet discharge block 800.

The chassis 2 is assembled by screwing together a chassis body 3, which is a box with an opening at the right, and a base plate (not depicted in the drawings), which is for covering the opening in the chassis body 3.

On a front surface 3*a* of the chassis body 3, operational switches 4, 4, . . . for operations required and a display 5 are disposed (refer to FIGS. 1 to 4). A slot 3*b* having an opening in the front is formed on the chassis body 3 (refer to FIGS. 1 to 6).

Figure 7:
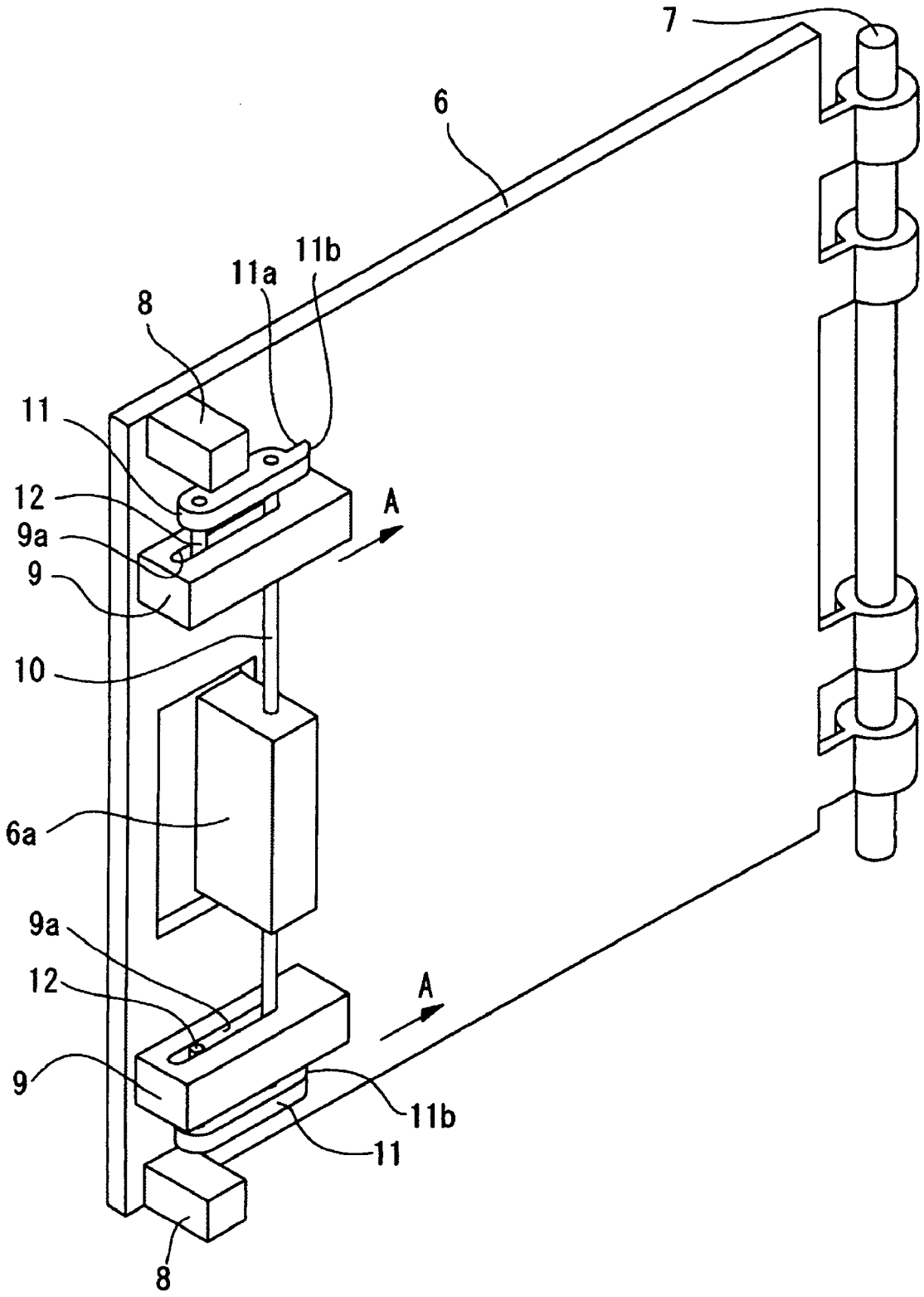
FIG. 7 is an enlarged perspective view of the outer cover.

On a side surface 3*c* of the chassis body 3, an outer cover 6 that can be opened to expose the inside of the chassis 2 is disposed. As depicted in FIG. 7, a supporting shaft 7 is formed on the rear edge of the outer cover 6. The outer cover 6 pivots on a supporting shaft 7 from the cover-open position to the cover-closed position. A handle 6*a* is formed close to the forward edge of the outer cover 6.

On the inner surface of the front edge of the outer cover 6, pressing protrusions 8 and 8 that protrude inwards are disposed on the upper and lower edges of the outer cover 6.

In the vicinity of the pressing protrusions 8 and 8 on the inner surface of the outer cover 6, supporting protrusions 9 and 9 are disposed. On each of the supporting protrusions 9 and 9, guide holes 9*a*, 9*a*, . . . , which extend in the longitudinal direction of the outer cover 6, are formed. A first shaft 10 passes through the guide holes 9*a*, 9*a*, . . . . At both ends of the first shaft 10, locking members 11 and 11 are disposed. In the middle of the first shaft 10 in the axial direction, a handle 6*a* is disposed.

The locking members 11 and 11 extend in the same direction as the guide holes 9*a*, 9*a*, . . . . At one of the ends of the locking members 11 and 11, locking notches 11*a* and 11*a* are formed so that the locking notches oppose the outer cover 6. At the same end of the locking members 11 and 11, but at the opposite side of the locking notches 11*a* and 11*a*, inclined surfaces 11*b* and 11*b* are formed. Second shafts 12 and 12 are attached to the locking members 11 and 11. These second shafts 12 and 12 pass through the guide holes 9*a*, 9*a*, . . . so that the second shafts 12 and 12 are slidable. Consequently, the locking members 11 and 11, respectively, are moveable by the first shaft 10 and the second shafts 12 and 12 being guided through the guide holes 9*a*, 9*a*, . . . . The locking members 11 and 11 are urged by springs (not illustrated in the drawings) disposed inside the supporting protrusions 9 and 9, respectively, toward the pivoting shaft of the outer cover 6 (in direction A in FIG. 7).

The sheet storage block 100 is disposed inside the chassis 2 at the right (refer to FIG. 5) and includes a storage tray 13 composed of a shallow box extending from the front to the rear (refer to FIGS. 8 to 12).

The storage tray 13 is disposed inside the slot 3*b* and is detachable from the chassis 2. When the storage tray 13 is disposed inside the slot 3*b*, a space is defined at the left of the storage tray 13. This space functions as a sheet ejecting space for ejecting the printing sheet 3000 to the outside.

Figure 8:
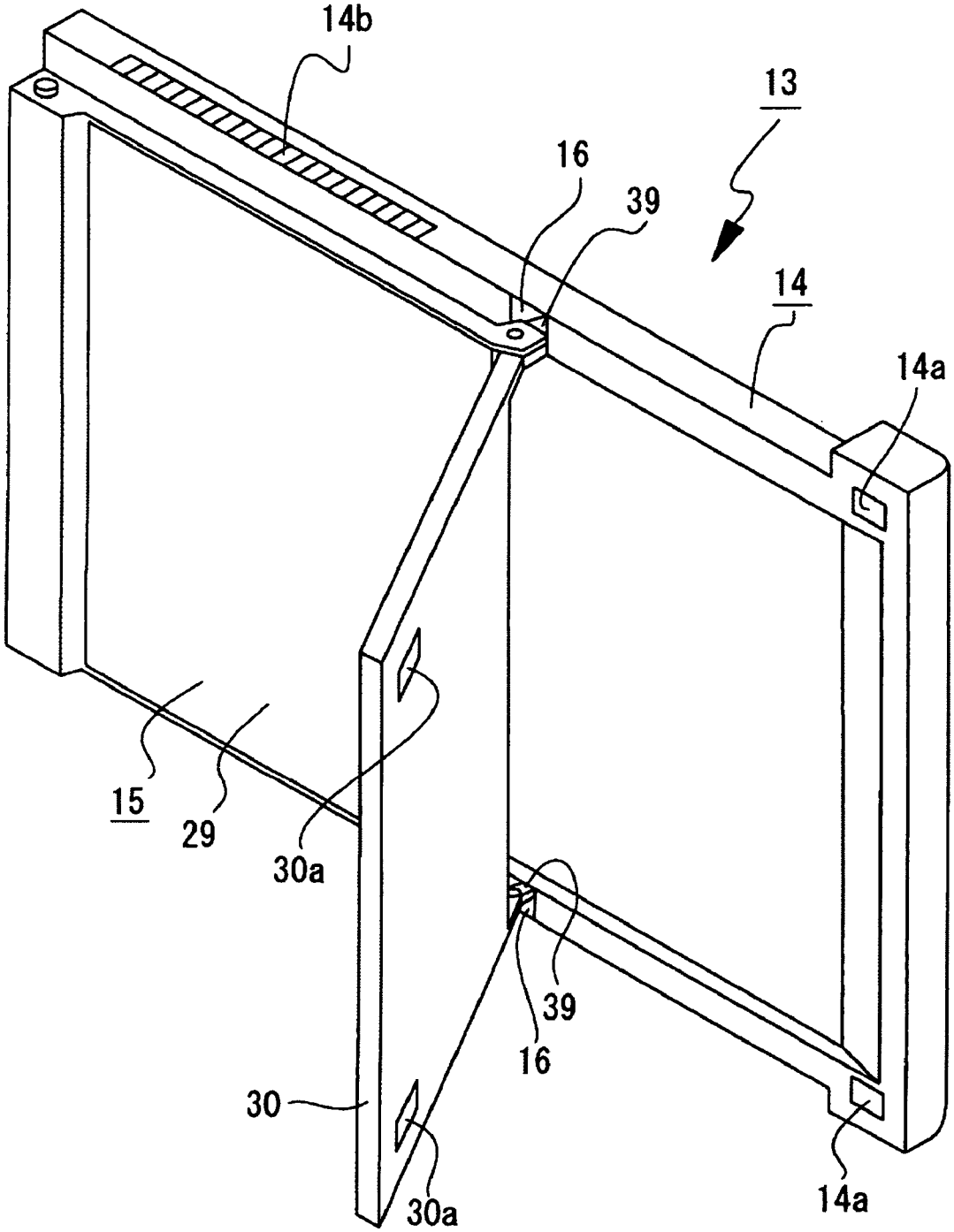
FIG. 8 is an enlarged perspective view of the storage tray.

The storage tray 13 includes a sheet storage case 14, which has an opening at the left, and a cover 15, which covers the opening at the sheet storage case 14 (refer to FIG. 8).

Figure 9:
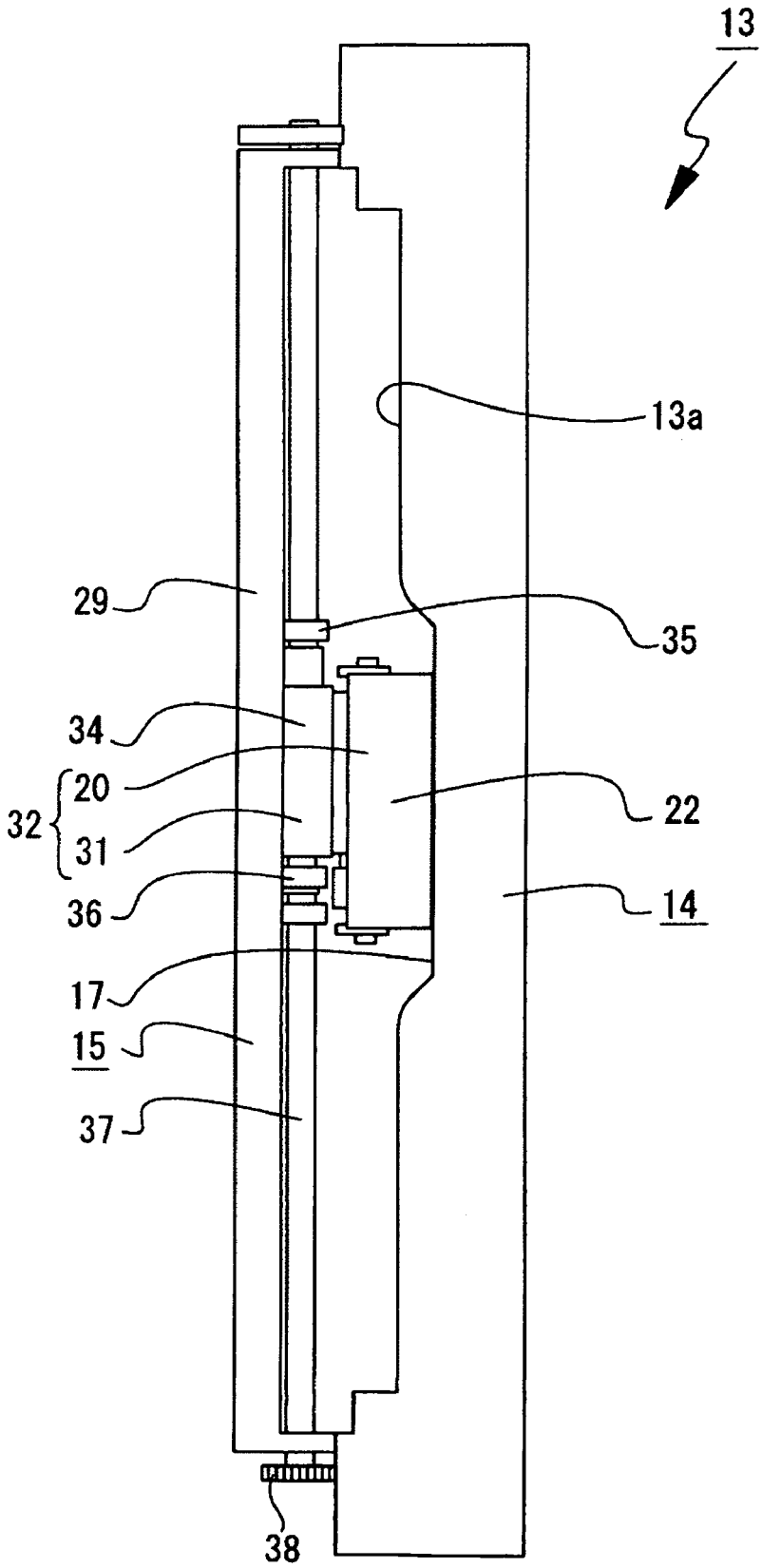
FIG. 9 is an enlarged rear view of the storage tray.

At the rear edge of the storage tray 13, a sheet ejecting slot 13*a* is formed (refer to FIG. 9).

At the front edge of the sheet storage case 14, metal plates 14*a* are disposed so that they oppose the upper and lower edges of the cover 15 (refer to FIG. 8). On the rear half of the upper and lower sides of the sheet storage case 14, racks 14*b* are formed. The racks 14*b* are engaged with gears (not depicted in the drawings) disposed inside the chassis 2 to ensure that the storage tray 13 can be smoothly ejected and inserted into the slot 3*b*.

Figure 11:
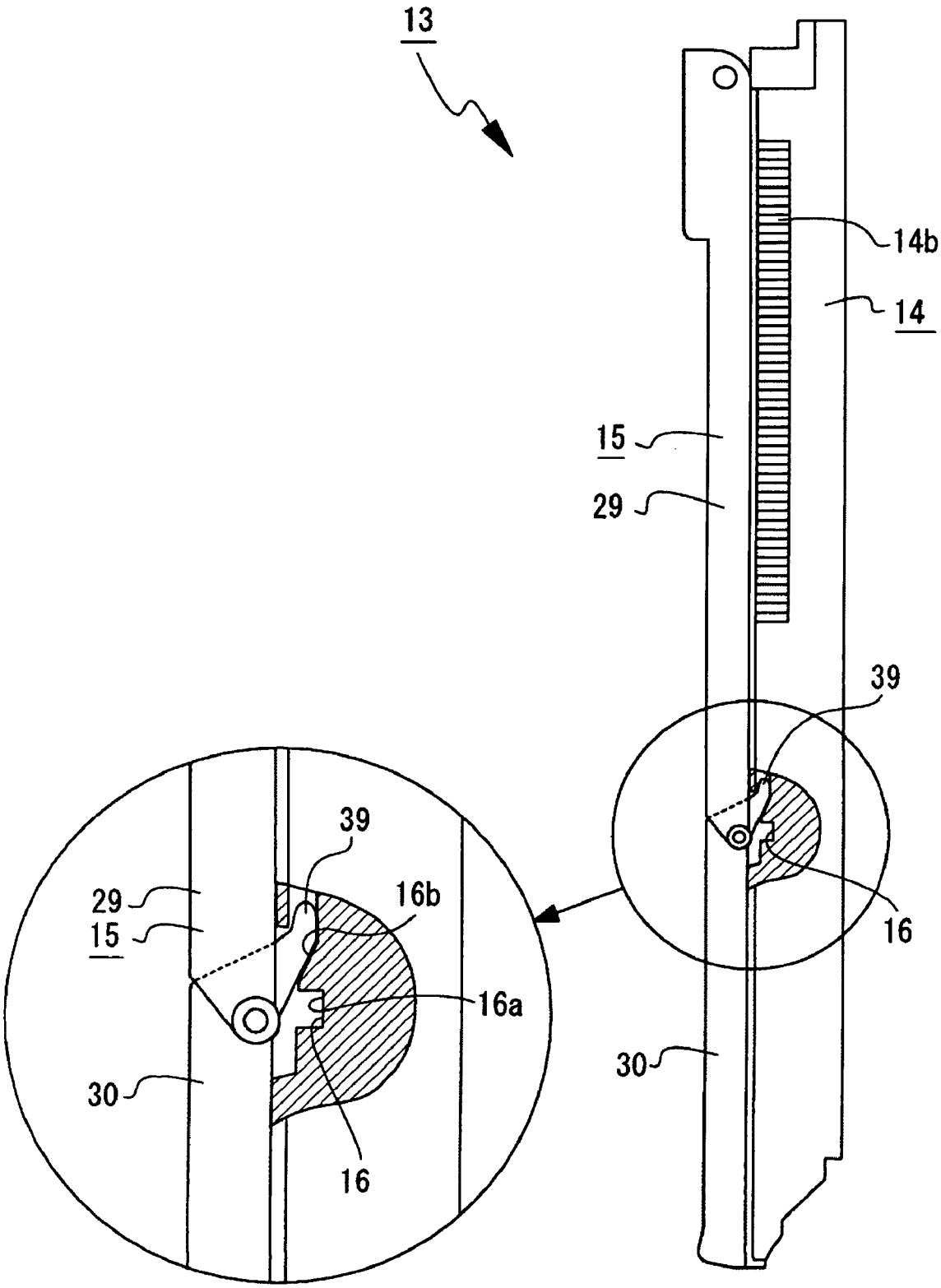
FIG. 11 is an enlarged plan view of a part of the storage tray when the moveable member of the cover is closed.
Figure 12:
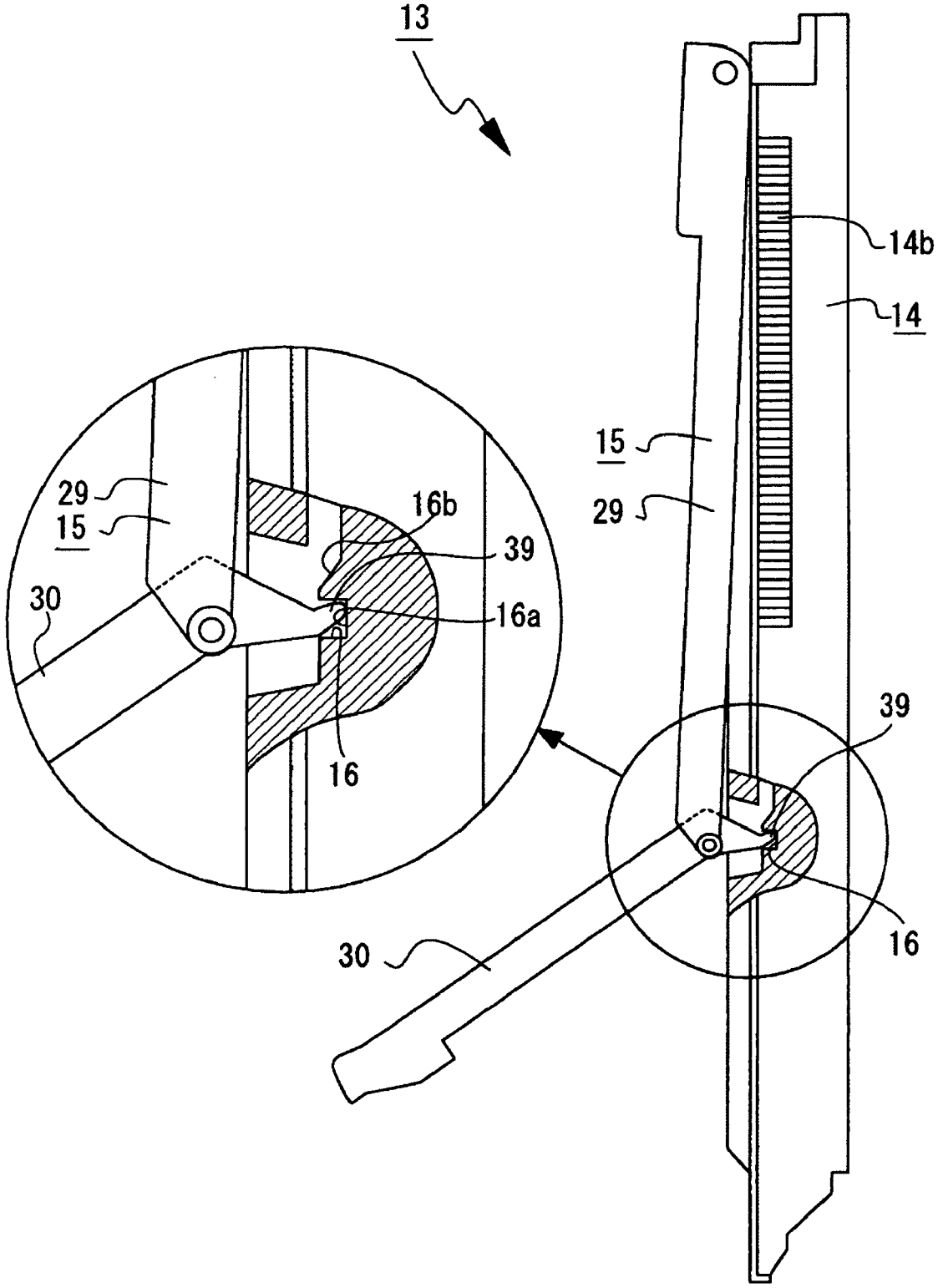
FIG. 12 is an enlarged plan view of a part of the storage tray when the moveable member of the cover is opened.

At the upper and lower edges of the sheet storage case 14, locking grooves 16 and 16 are directed to the left (refer to FIGS. 11 and 12). Each of the locking grooves 16 and 16 includes a releasing engagement groove 16*a* located in the middle of the front and the rear and a stopping engagement portion 16*b* located behind the releasing engagement portion 16*a*. The releasing engagement portion 16*a* is a depression with an opening at the left. The stopping engagement portion 16*b* becomes deeper towards the rear and has an opening on the rear surface.

A biasing spring, not depicted in the drawings, is disposed inside the sheet storage case 14. The biasing spring biases the printing sheets 3000 stored in the sheet storage case 14 toward a pick-up roller to be described below.

Figure 13:
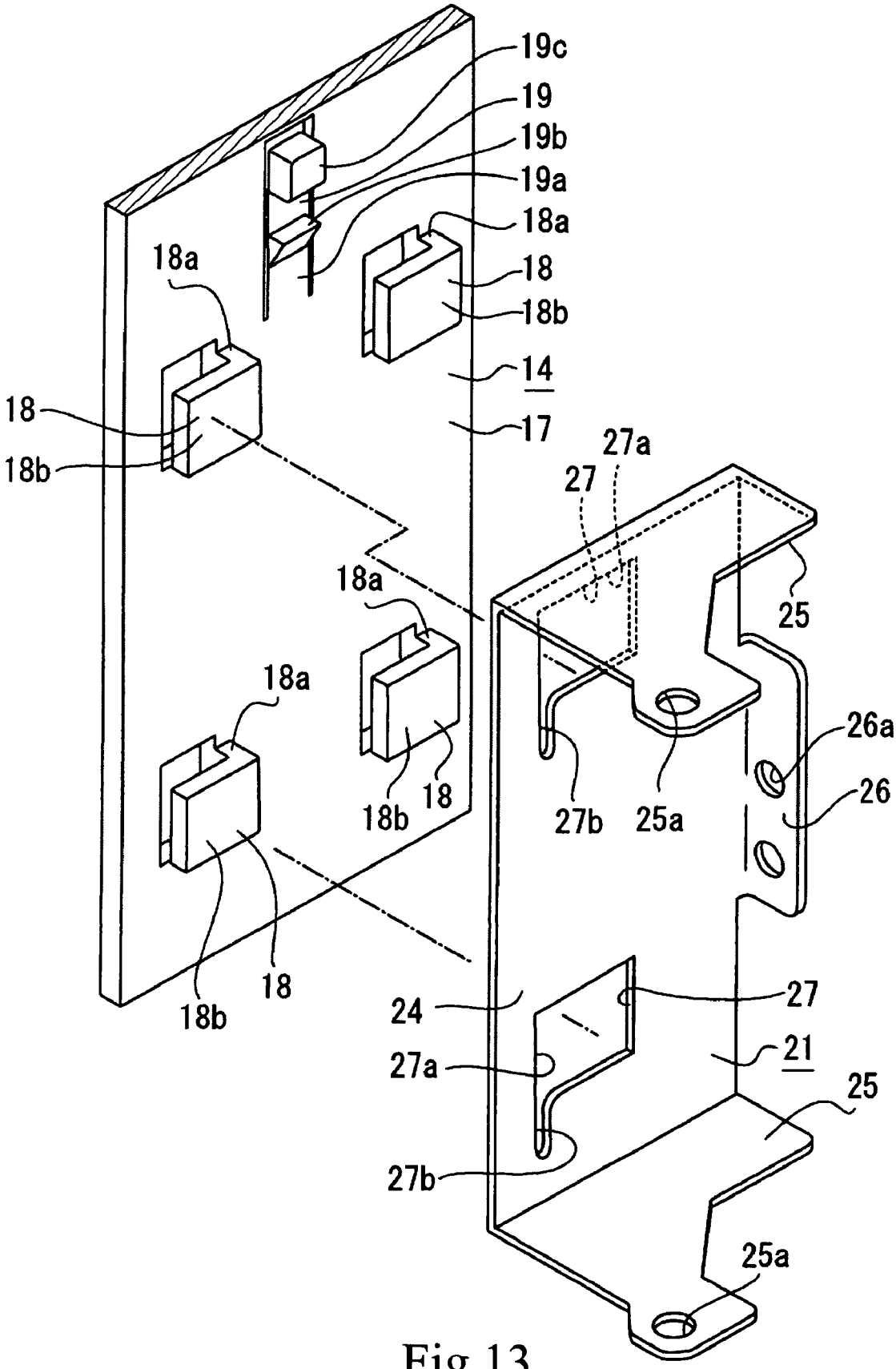
FIG. 13 is an enlarged perspective view of the unit attachment portion of the storage tray and the bracket of the first roller unit.

On the rear edge of the sheet storage case 14, as illustrated in FIG. 13, a unit attachment portion 17 is formed. The unit attachment portion 17 includes four engagement pieces 18, 18, . . . and a locking piece 19. Each engagement piece 18 is composed of a base 18*a* protruding to the left and a restraining portion 18*b* protruding to the rear from the left edge of the base 18*a*. The locking piece 19 is an integral piece of a resilient portion 19*a*, which extends in the vertical direction and is resilient, a latching protrusion 19*b*, which is formed substantially in the middle of the longitudinal direction and protrudes leftward, and a lock releasing protrusion 19*c*, which is formed at the tip of the resilient portion 19*a*.

Figure 14:
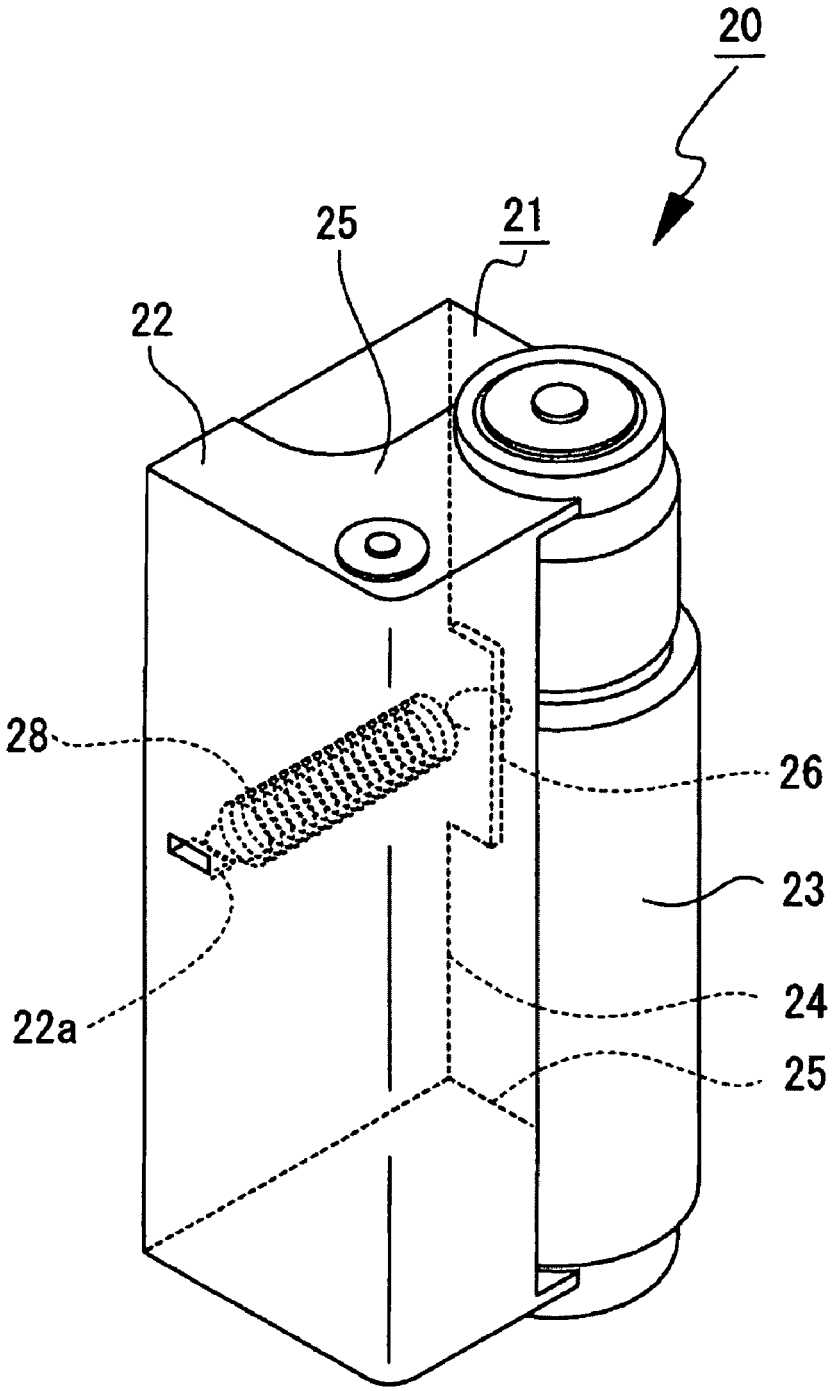
FIG. 14 is an enlarged perspective view of the first roller unit.

On the unit attachment portion 17, a first roller unit 20 is attached (refer to FIGS. 13 and 14). The first roller unit 20 is a component of the pick-up block 200 and includes a bracket 21, a roller holder 22, and a separating roller 23, as illustrated in FIG. 14.

The bracket 21 is composed of a plate material, as illustrated in FIG. 13, and includes a base 24, supports 25 and 25, which protrude leftward from the upper and lower edges of the base 24, and a spring attachment portion 26, which protrude leftward from the front edge of the base 24.

The base 24 has two attachment holes 27 and 27 distant from each other in the upper and lower regions. The attachment hole 27 includes a rectangular engagement region 27*a* and a catching region 27*b* extending downward from the rear edge of the engagement region 27*a*.

At the tips of the support 25 and 25, support holes 25*a* and 25*a* are formed.

On the spring attachment portion 26, a spring attachment hole 26*a* is formed.

The roller holder 22 is supported by the support holes 25*a* and 25*a* of the bracket 21 and is rotatable around the bracket 21 (refer to FIG. 14). In the front of the roller holder 22, a separating roller 23 is supported such that the separating roller 23 is freely rotatable.

The roller holder 22 has a spring attachment protrusion 22*a*. A helical extension spring 28 is suspended between the spring attachment protrusion 22*a* and the spring attachment hole 26*a* of the spring attachment portion 26 of the bracket 21. Consequently, the separating roller 23 supported by the roller holder 22 is urged away from the base 24 of the bracket 21.

The first roller unit 20 is attached to the unit attachment portion 17 as described below (refer to FIGS. 15 to 17).

Figure 15:
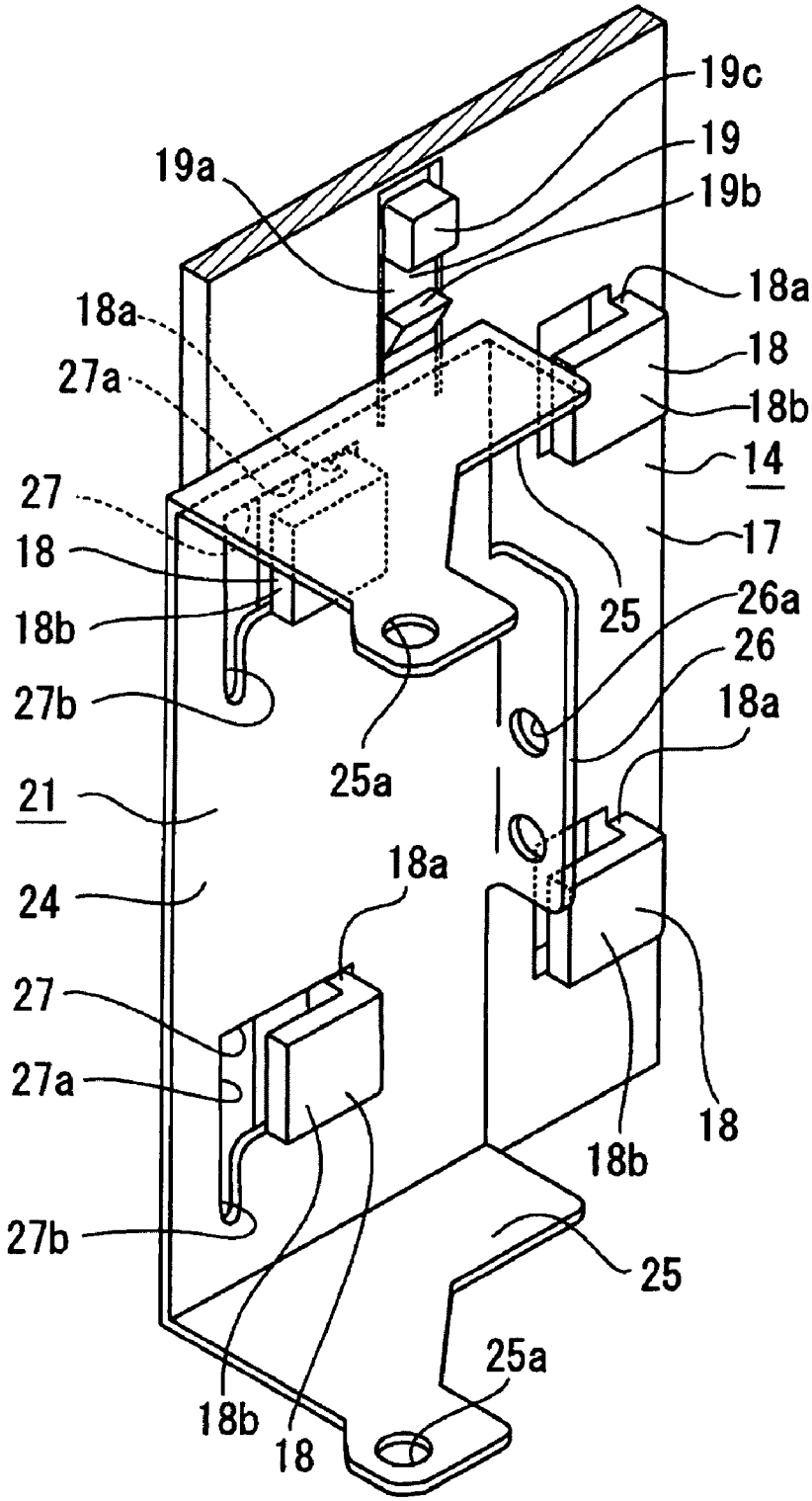
FIG. 15, together with FIGS. 16 and 17, illustrates the procedures of attaching the first roller unit to the unit attachment portion and is an enlarged perspective view illustrating the engagement pieces being disposed inside the attachment holes of the bracket.
Figure 16:
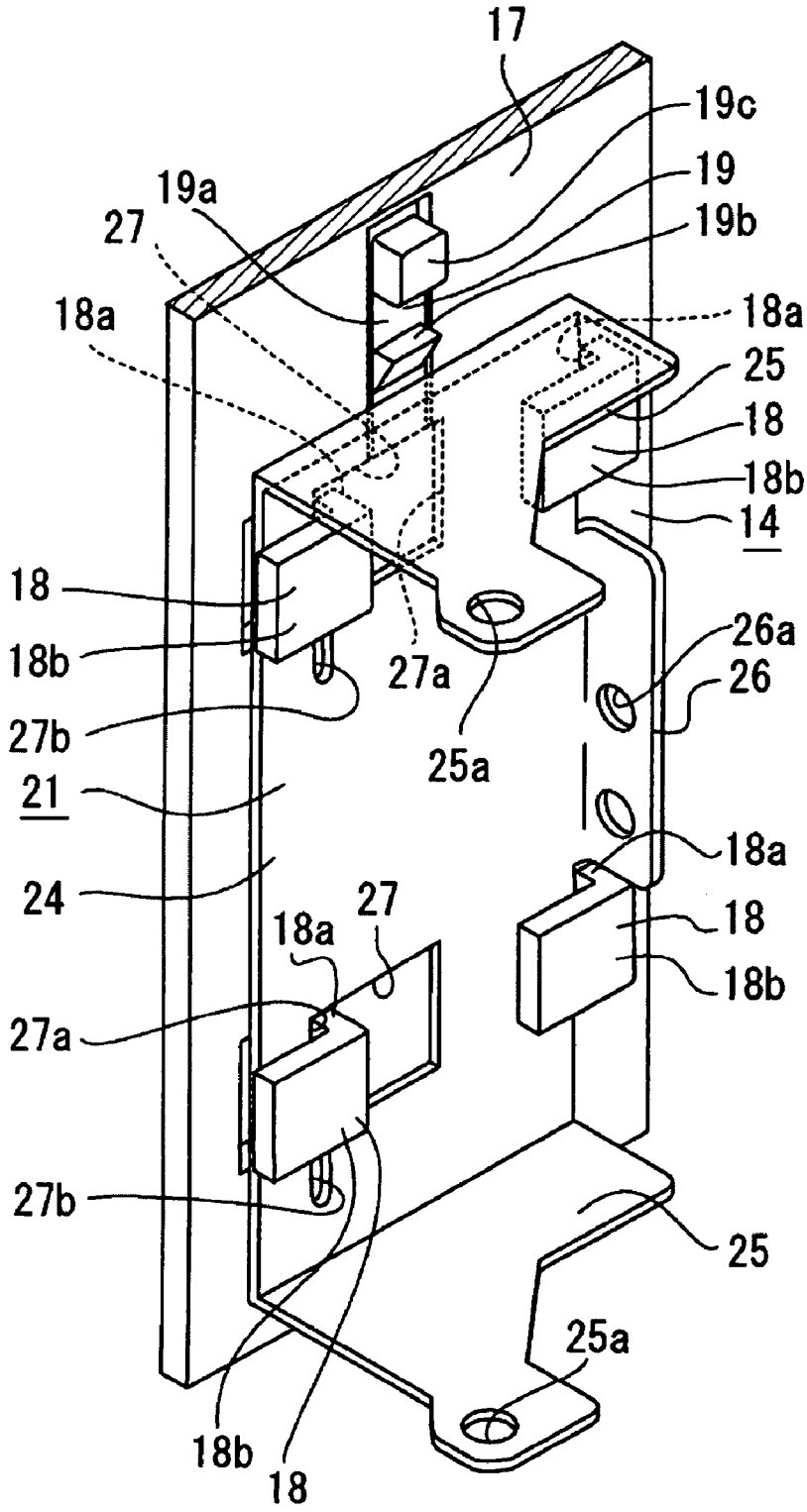
FIG. 16 is an enlarged perspective view illustrating the first roller unit when slid forward.

First, the engagement pieces 18 and 18, which are located behind the bracket 21 of the attachment holes 27 and 27 of the bracket 21, are engaged with the engagement regions 27*a* and 27*a* (refer to FIG. 15). The forward engagement pieces 18 and 18 on the bracket 21 are located in front of the forward edge of the bracket 21, and the latching protrusion 19*b* of the locking pieces 19 is pressed rightward by the base 24 of the bracket 21 and is elastically deformed.

Figure 17:
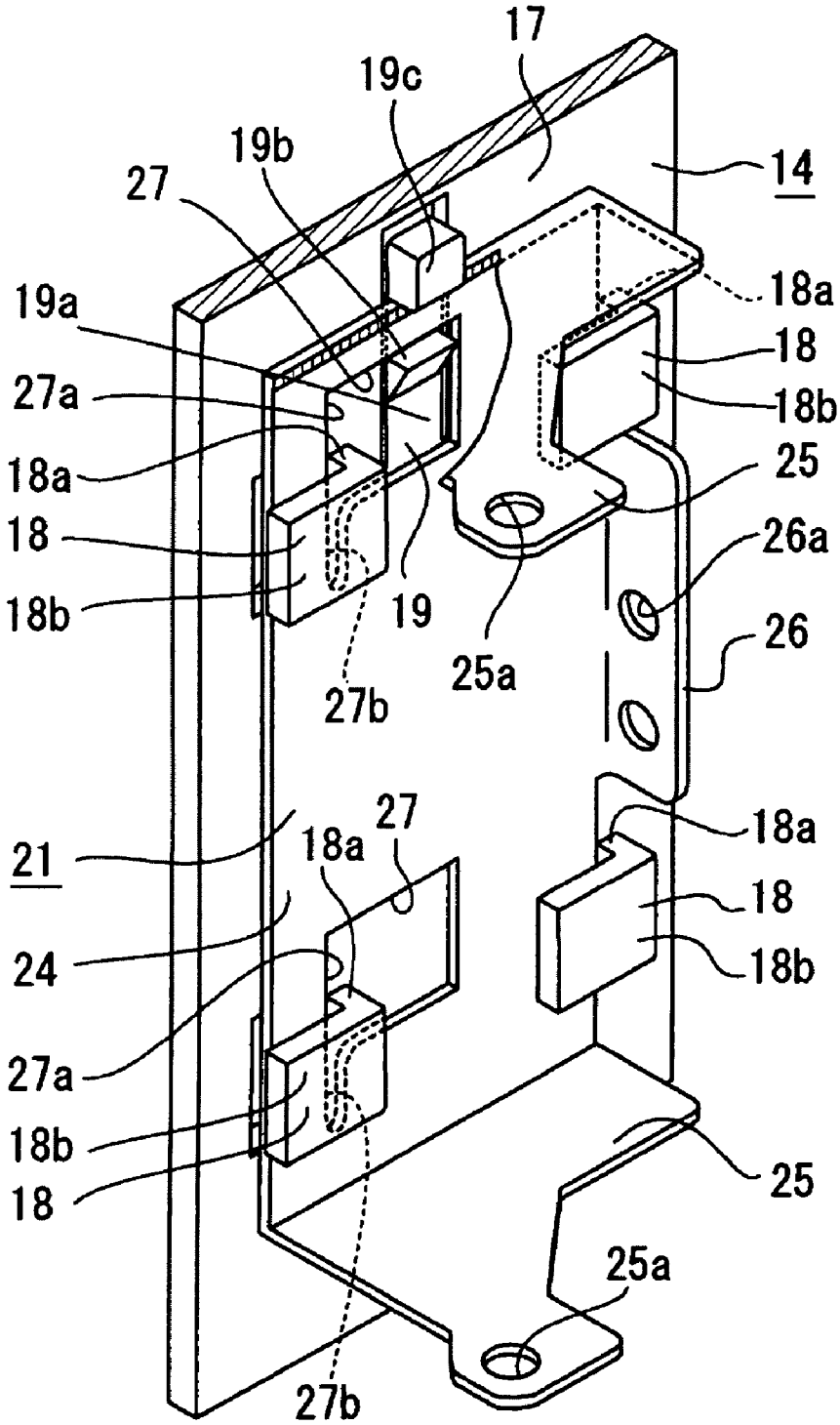
FIG. 17 is an enlarged perspective view illustrating the first roller unit 20 when attached to the unit attachment portion.

Next, the first roller unit 20 is slid forward (refer to FIG. 16), and, then, the first roller unit 20 is slid upward (refer to FIG. 17). By sliding the first roller unit 20 forward and then upward, the rear bases 18*a* and 18*a* of the engagement pieces 18 and 18 are engaged with the catching regions 27*b* and 27*b* of the attachment holes 27 and 27; the restraining portions 18*b*, 18*b*, . . . of the engagement pieces 18, 18, . . . hold the front and the rear edges of the bracket 21; and the latching protrusion 19*b* of the locking piece 19 that has elastically recovered is latched to the edge of the opening of the upper attachment hole 27; and the first roller unit 20 is attached to the unit attachment portion 17.

To remove the first roller unit 20 from the unit attachment portion 17, the lock releasing protrusion 19*c* of the locking piece 19 is pressed to the right to release the latching by the latching protrusion 19*b*, which is latched to the edge of the opening of the attaching hole 27, and the first roller unit 20 is slid down and then to the back.

Since the first roller unit 20 is freely detachable from the unit attachment portion 17 of the sheet storage case 14 as described above, the first roller unit 20 may be quickly and easily replaced when required for reasons such as wearing of the separating roller 23.

As described above, the bracket 21 and the unit attachment portion 17 may be fixed with screws for reinforcement while the first roller unit 20 is attached to the unit attachment portion 17.

Figure 10:
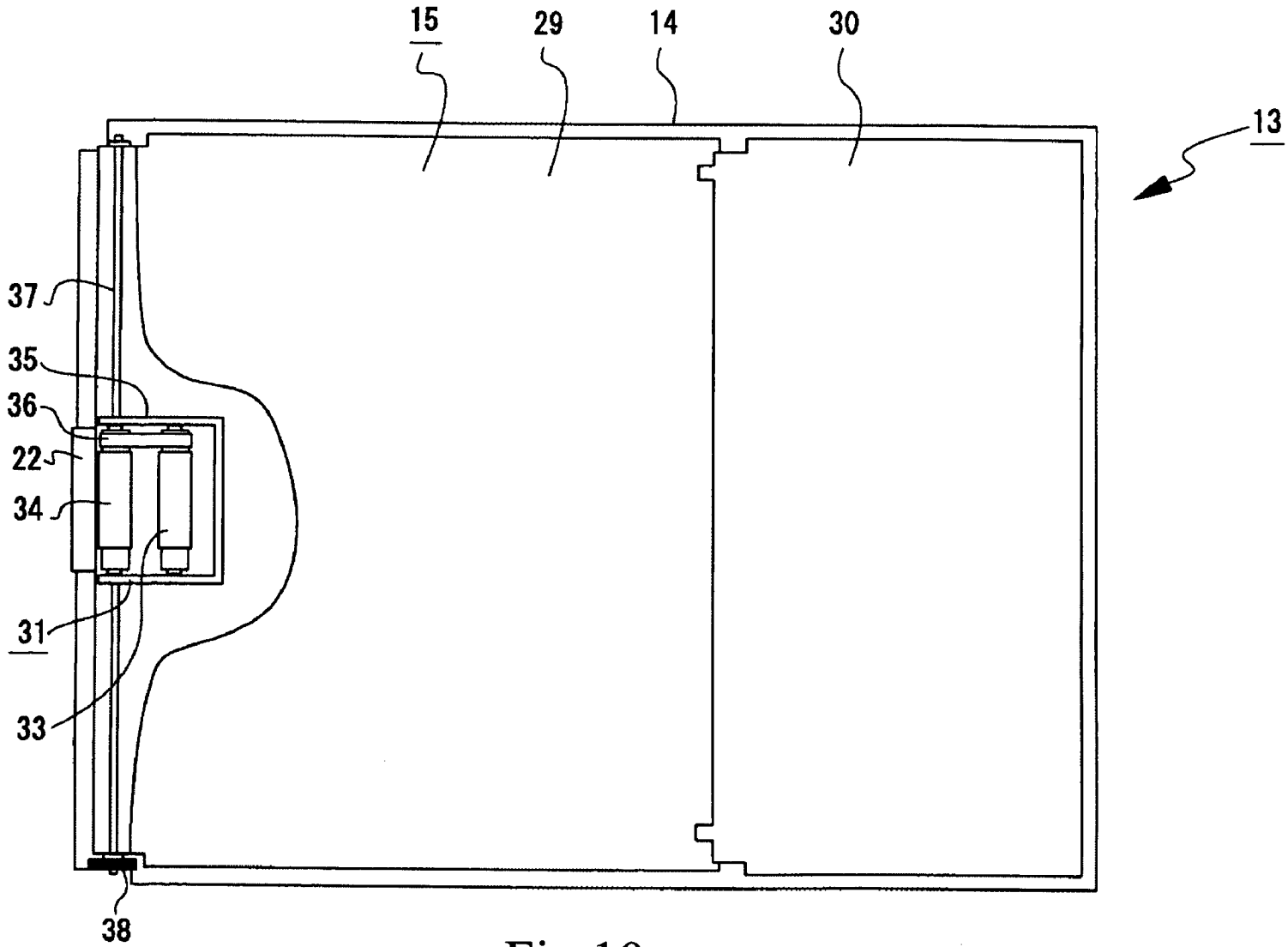
FIG. 10 is an enlarged side view of a part of the storage tray.

The cover 15 includes a cover body 29 positioned in the rear and a moveable member 30 that pivots on the cover body 29 (refer to FIGS. 8 and 10).

A second roller unit 31 is attached to the inner side of the rear edge of the cover body 29 (refer to FIG. 10). The second roller unit 31, similar to the first roller unit 20, is a component of the pick-up block 200. The first roller unit 20 and the second roller unit 31 form a pick-up mechanism 32 (refer to FIG. 9).

The second roller unit 31, as illustrated in FIG. 10, includes a pick-up roller 33, a feeding roller 34, and a holder bracket 35. The holder bracket 35 is fixed to the cover body 29 by, for example, screws.

The pick-up roller 33 and the feeding roller 34 are rotatably supported by the holder bracket 35 apart from each other at the front and the rear. The pick-up roller 33 and the feeding roller 34 are synchronously rotated by a transmission belt 36 connecting the two rollers. The feeding roller 34 opposes the separating roller 23 of the first roller unit 20 (refer to FIG. 6).

The feeding roller 34, as illustrated in FIG. 10, is fixed to the middle of the axial direction of a power transmission shaft 37, which extends in the vertical direction. The ends of the power transmission shaft 37 are rotatably supported at the upper and lower edges of the cover body 29. The lower end of the power transmission shaft 37 penetrates through the lower surface of the cover body 29. A transmission gear 38 is fixed to the portion of the power transmission shaft 37 that penetrates through the cover body 29.

The transmission gear 38 is engaged to a connection gear, not depicted in the drawings, when the storage tray 13 is inserted into the slot 3*b* of the chassis 2. When the transmission gear 38 is engaged with the connection gear, the power generated by a driving motor, not depicted in the drawings, disposed inside the chassis 2 is transmitted to the feeding roller 34 via the transmission gear 38 and the power transmission shaft 37. In this way, the feeding roller 34 and the pick-up roller 33 are synchronously rotated.

As described above, since the pick-up mechanism 32 composed of the first roller unit 20 and the second roller unit 31 is attached to the storage tray 13 of the printer 1, maintenance work such as replacement or repair required due to wearing of the separating roller 23, the pick-up roller 33, and/or the feeding roller 34 can be carried out by pulling out the storage tray 13 from the slot 3*b* of the chassis 2. In this way, the time required for maintenance work can be reduced and the work can be carried out easily.

Since the pick-up mechanism 32 is attached to the storage tray 13, a sufficient accuracy of positioning of the separating roller 23, the pick-up roller 33, feeding roller 34, and the storage tray 13 can be maintained. In this way, defects such as failure of paper feeding and/or jamming of a printing sheet can be prevented.

Furthermore, since the first roller unit 20 having the separating roller 23 is disposed on the sheet storage case 14 and the second roller unit 31 having the printer pick-up roller 33 and the feeding roller 34 is disposed on the cover 15, the maintenance work for the first roller unit 20 and the second roller unit 31 can be performed separately. In this way, the necessary maintenance work can be carried out and the workability can be improved.

The moveable member 30 is rotatably supported on the rear edge of the cover body 29 (refer to FIG. 8). On the inner surface of the front edge of the moveable member 30, magnets 30*a* and 30*a* are disposed separated from each other at the upper and lower regions. The magnets 30*a* and 30*a* stick to the metal plates 14*a* and 14*a* on the sheet storage case 14 to maintain the closed condition of the moveable member 30.

On the rear edge of the moveable member 30, locking protrusions 39 and 39 are formed at the upper and lower edges (refer to FIGS. 11 and 12).

When the moveable member 30 is closed, as illustrated in FIG. 11, stopping engagement portions 16*b* and 16*b* of the locking grooves 16 and 16 of the sheet storage case 14 are engaged with the locking protrusions 39 and 39 and the moveable member 30 is locked.

When the moveable member 30 is pivoted from the closed condition, the locking protrusions 39 and 39 slide along the bottom surfaces of the locking grooves 16 and 16 while in contact. When the moveable member 30 is pivoted to a predetermined angle, the locking protrusions 39 and 39 are engaged to the releasing engagement portion 16*a* and 16*a* and the moveable member 30 is locked at an opened condition (refer to FIG. 12). At this time, the cover body 29 is inclined so that is its front portion is raised to a certain degree from the sheet storage case 14.

On the other hand, when the moveable member 30 is raised further from the sheet storage case 14 when at an opened condition, the engagement between the locking protrusions 39 and 39 and the releasing engagement portions 16*a* and 16*a* is released. By further pivoting the moveable member 30, the locking protrusions 39 and 39 are engaged with the stopping engagement portions 16*b* and 16*b* again, and the moveable member 30 is locked at a closed condition.

As described above, the cover 15 of the storage tray 13 is composed of the cover body 29 and the moveable member 30, which is rotatably supported by the cover body 29. By pivoting the moveable member 30, the printing sheets 3000, 3000, . . . can be fed to or discharged from the sheet storage case 14.

In the printer 1, as illustrated in FIGS. 2 and 4, a part of the storage tray 13 can be pulled out from the slot 3*b* of the chassis 2 to feed or discharge the printing sheets 3000, 3000, . . . to or from the sheet storage case 14. In this way, the efficiency of feeding or discharge of the printing sheets 3000, 3000, . . . to or from the storage tray 13 can be improved.

Since the entire storage tray 13 does not need to be pulled out from the slot 3*b*, the storage tray 13 can be loaded into the slot 13*b* quickly and easily.

When a part of the storage tray 13 is disposed inside the chassis 2, the printing sheets 3000, 3000, . . . can be fed to or discharged from the sheet storage case 14. Therefore, not only the storage tray 13 but also the chassis 2 bears the weight of the printing sheets 3000, 3000, . . . . Thus, a reinforcement structure does not need to be formed on the storage tray 13 and the components of the storage tray 13 do not need to be thickened for reinforcement.

In addition, the locking protrusions 39 and 39 are formed on the moveable member 30 of the storage tray 13 and the locking protrusions 39 and 39 are engaged with the locking grooves 16 and 16 of the sheet storage case 14 and locked in either the opened or closed condition. For this reason, feeding and discharge of the printing sheets 3000, 3000, . . . to or from the storage tray 13 can be performed smoothly and the falling out of printing sheets 3000, 3000, . . . from the sheet storage case 14 can be reliably prevented.

When the storage tray 13 is disposed inside the slot 3*b* of the chassis 2 and the driving motor disposed in the chassis 2 is activated, the pick-up roller 33 is rotated and the printing sheet 3000 is taken out from the storage tray 13. The printing sheet 3000 after being taken out is fed to the delivery block 300 via the separating roller 23 and the feeding roller 34. At this time, the separating roller 23 separates each of the printing sheets 3000.

The delivery block 300 is disposed at the rear end inside the chassis 2 (refer to FIG. 5) and includes delivery rollers 40 and 40. The delivery rollers 40 and 40 are rotated synchronously and deliver the printing sheet 3000 to the positioning block 400.

Figure 18:
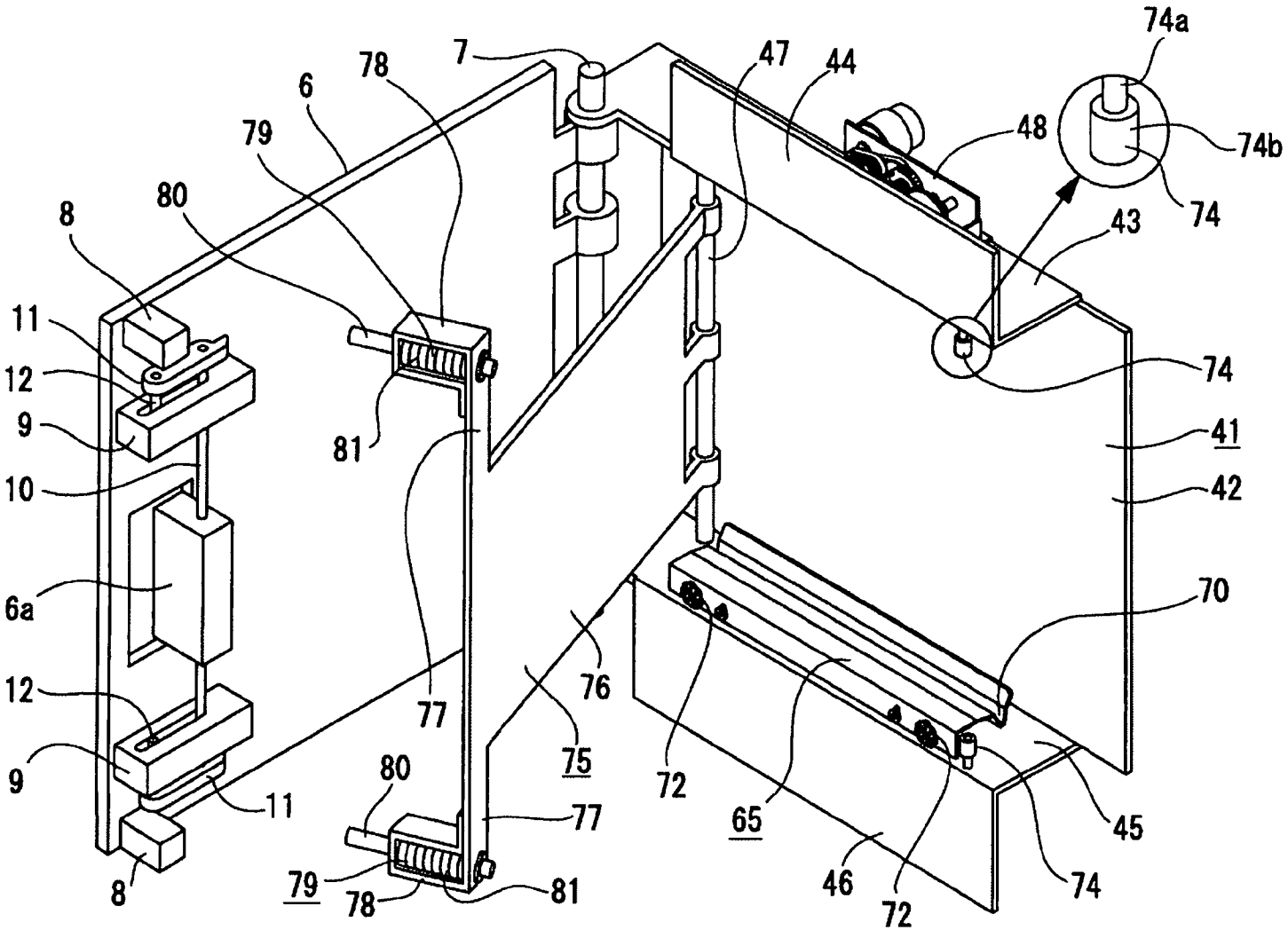
FIG. 18 is a perspective view when the outer cover is opened and the inner cover and chassis are opened.
Figure 19:
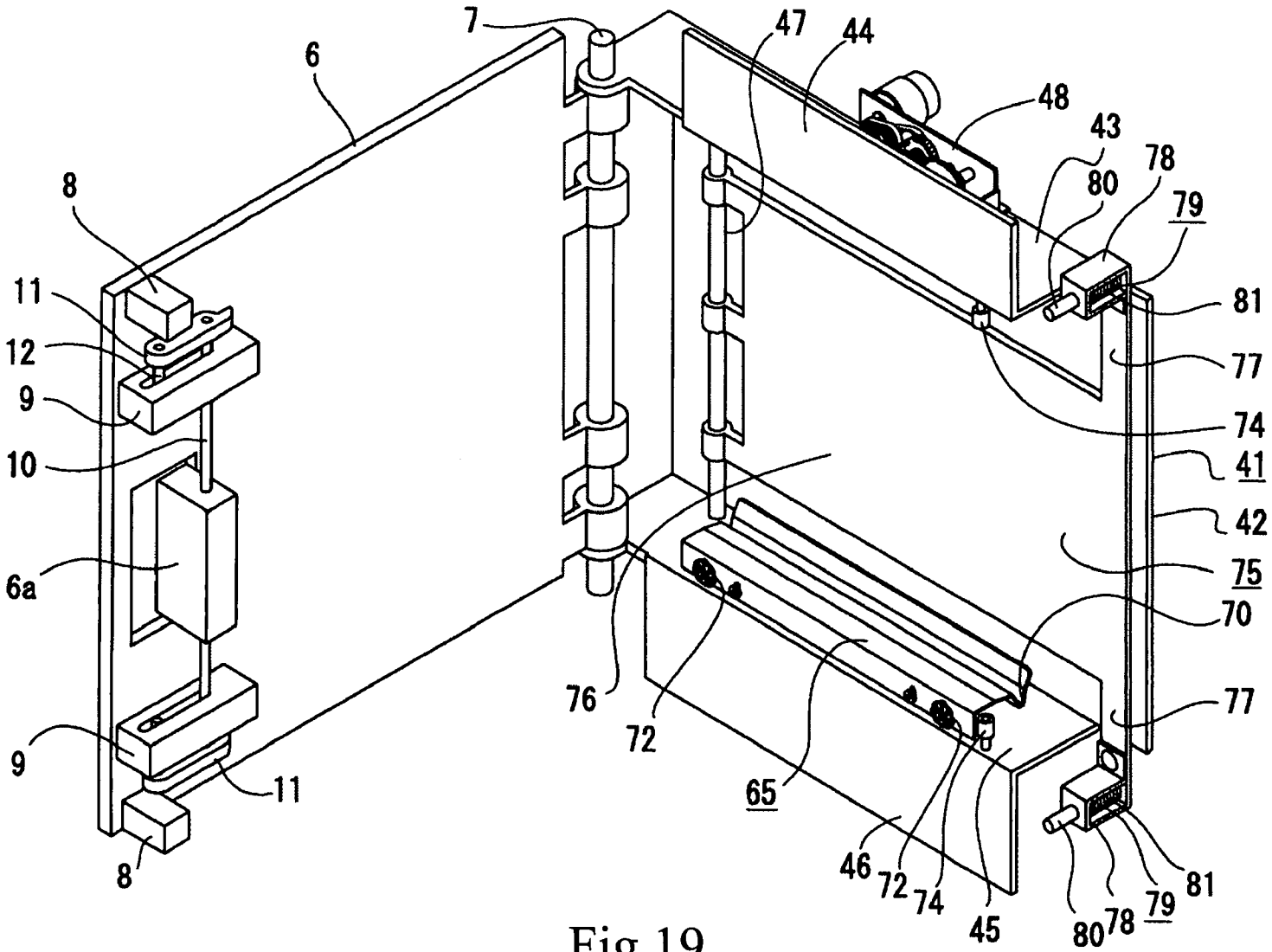
FIG. 19 is a perspective view when the outer cover is opened and the inner cover and the chassis are closed.

The positioning block 400 is disposed at the left edge inside the chassis 2 in front of the delivery block 300 (refer to FIG. 5) and includes a chassis 41 (refer to FIGS. 18 and 19).

The chassis 41 includes a base surface 42, which faces the left and right direction, a first mechanism positioning region 43, which protrudes leftward from the upper edge of the base surface 42, an upper surface 44, which protrudes upward from the left edge of the first mechanism positioning region 43, a second mechanism positioning region 45, which protrudes leftward from the lower edge of the base surface 42, and a lower surface 46, which protrudes downward from the left of the second mechanism positioning region 45.

Between the first mechanism positioning region 43 and the second mechanism positioning region 45, a supporting point shaft 47 is rotatably supported at a position close to the rear edge of the base surface 42. Between the first mechanism positioning region 43 and the second mechanism positioning region 45, the supporting shaft 7 with the outer cover 6 attached is rotatably supported at the rear edge of the regions 43 and 45 at a position left of the supporting point shaft 47.

Figure 21:
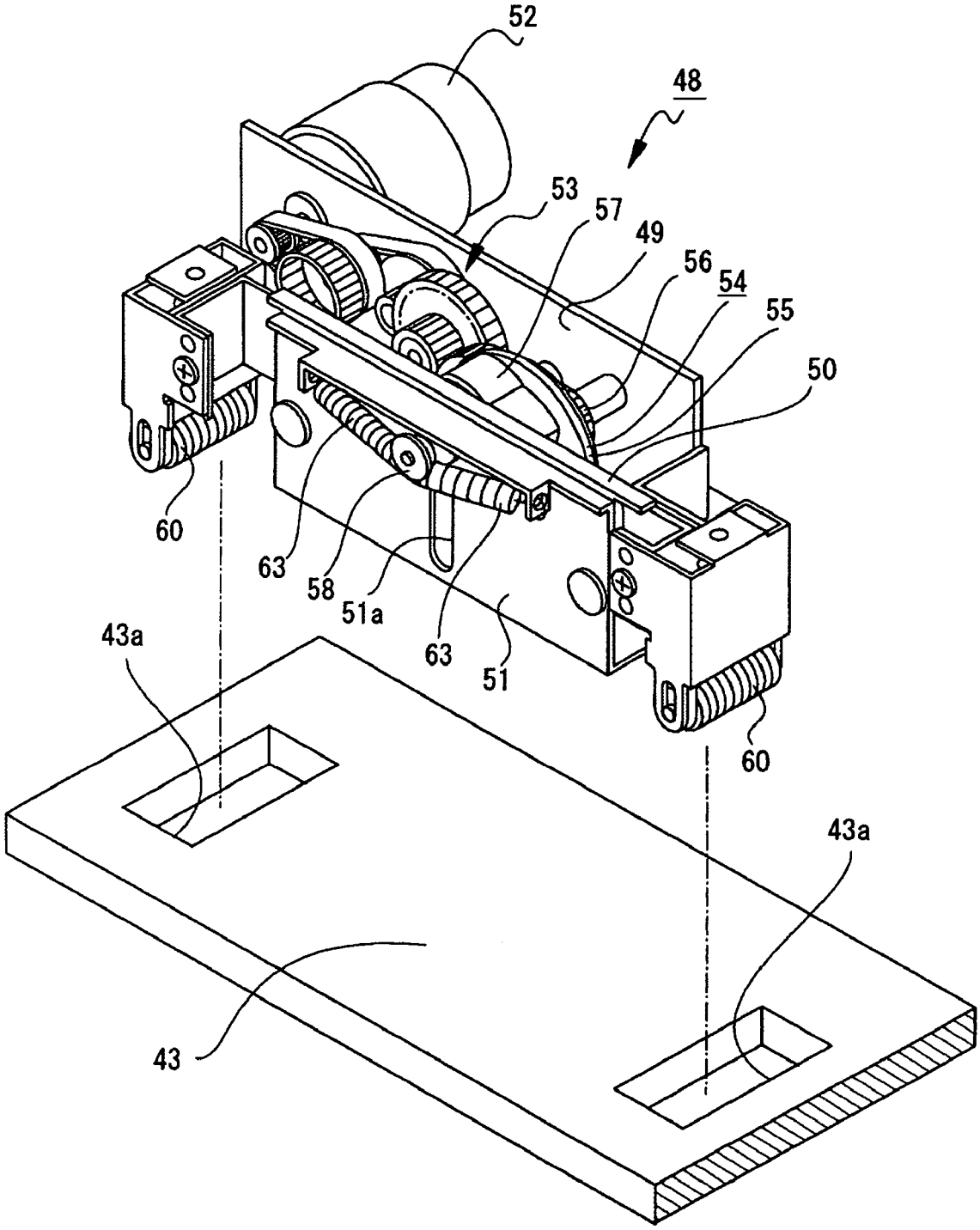
FIG. 21 is an enlarged perspective view of the position changing mechanism and a part of the chassis wherein the rollers are positioned at the upper edge of the moving range.

On the first mechanism positioning region 43, roller insertion holes 43*a* and 43*a* are formed apart from each other at the front and the rear (refer to FIG. 21).

Figure 20:
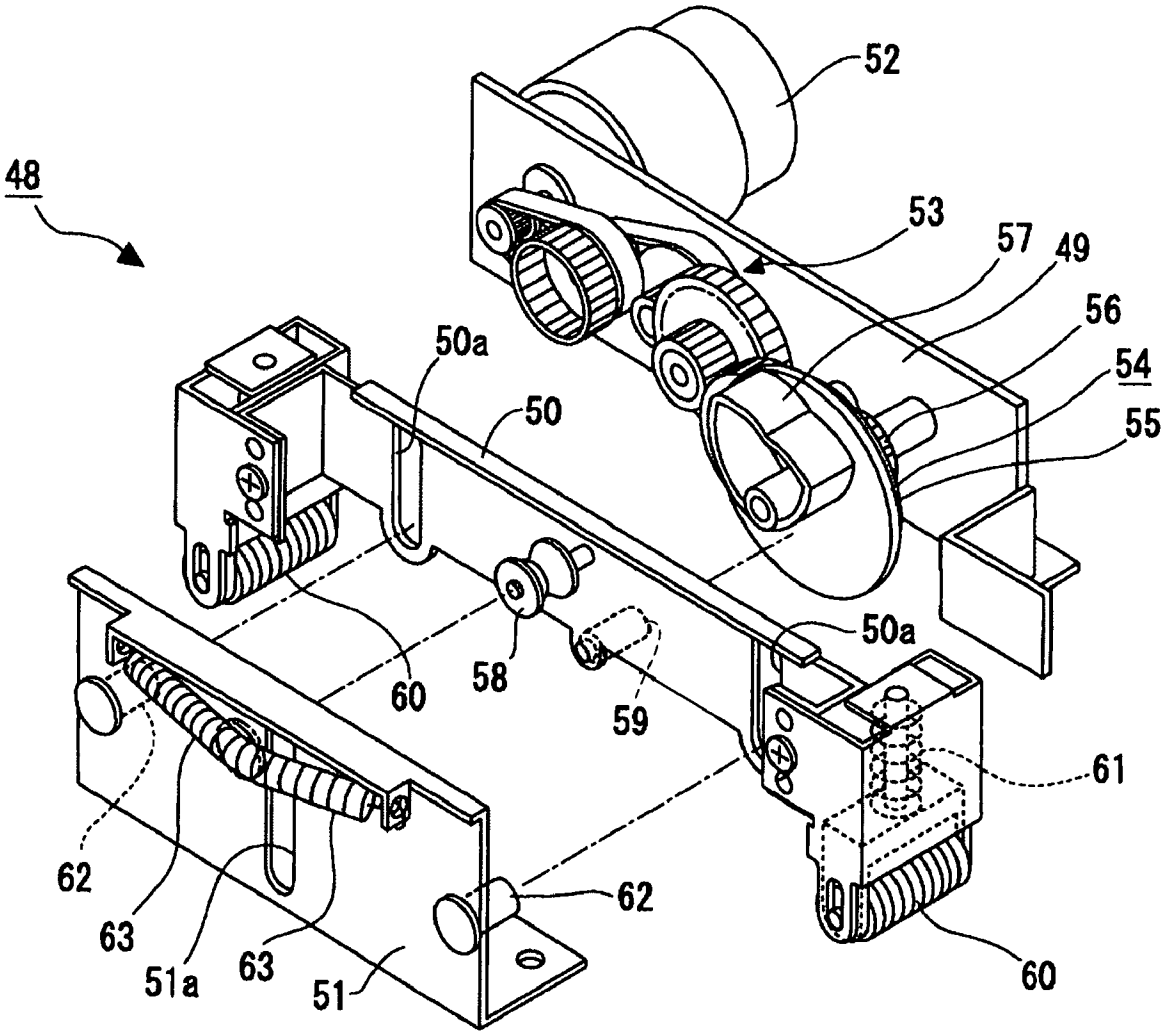
FIG. 20 is an enlarged perspective view of the position changing mechanism.
Figure 22:
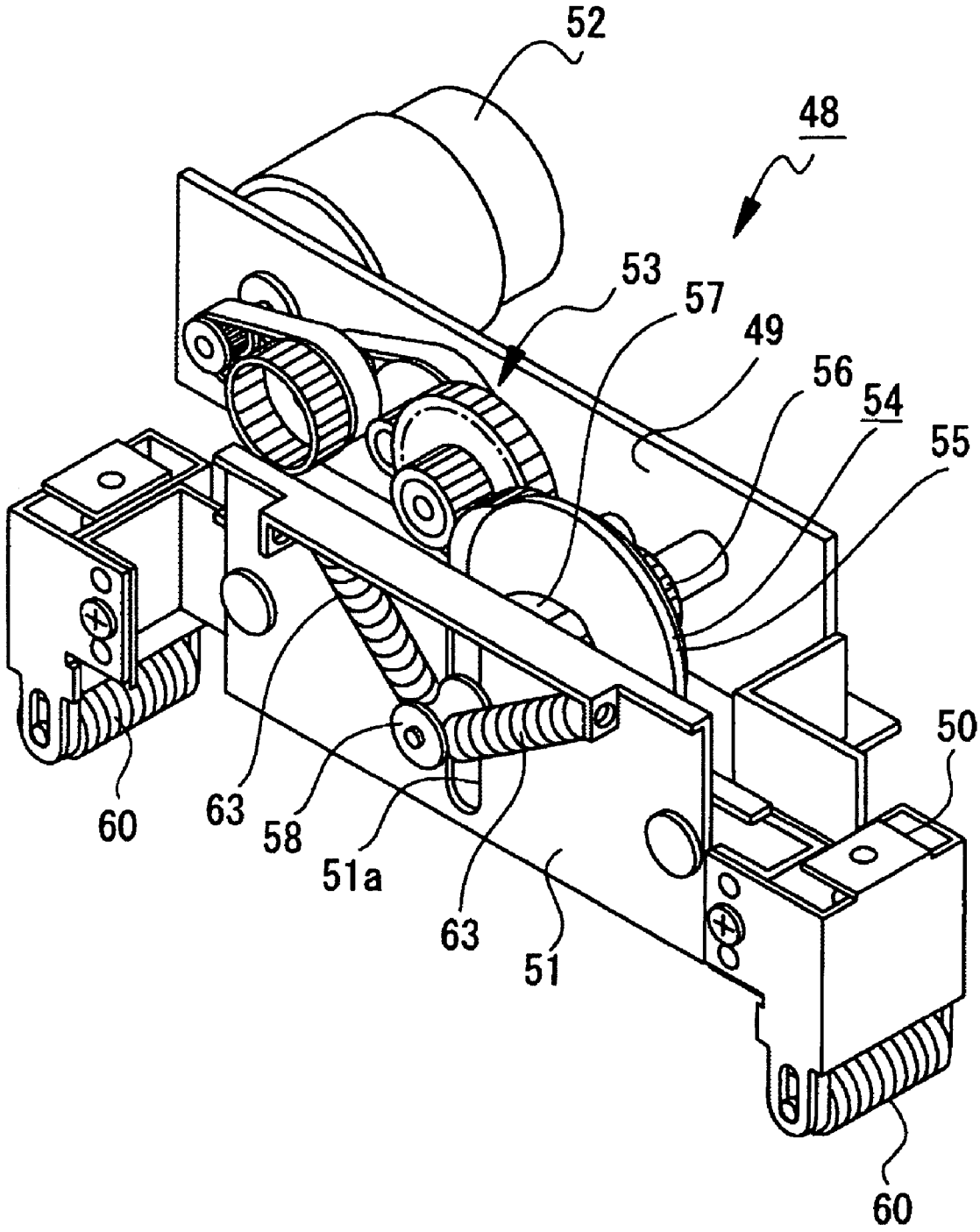
FIG. 22 is an enlarged perspective view of the position changing mechanism wherein the rollers are positioned at the lower edge of the moving range.

On the upper surface of the first mechanism positioning region 43, a position changing mechanism 48 is disposed (refer to FIGS. 18 and 19). The position changing mechanism 48, as illustrated in FIGS. 20 to 22, is composed by disposing the necessary parts on a first placement plate 49, a second placement plate 50, and a third placement plate 51 each disposed apart at the left and the right. The first placement plate 49 and the third placement plate 51 are attached to the first mechanism positioning region 43. The second placement plate 50 is supported so that it is vertically moveable relative to the first placement plate 49 and the third placement plate 51.

An actuating motor 52 is attached to the first placement plate 49 positioned on the right, and a gear group 53 and a cam 54 are rotatably supported by the first placement plate 49.

Figure 23:
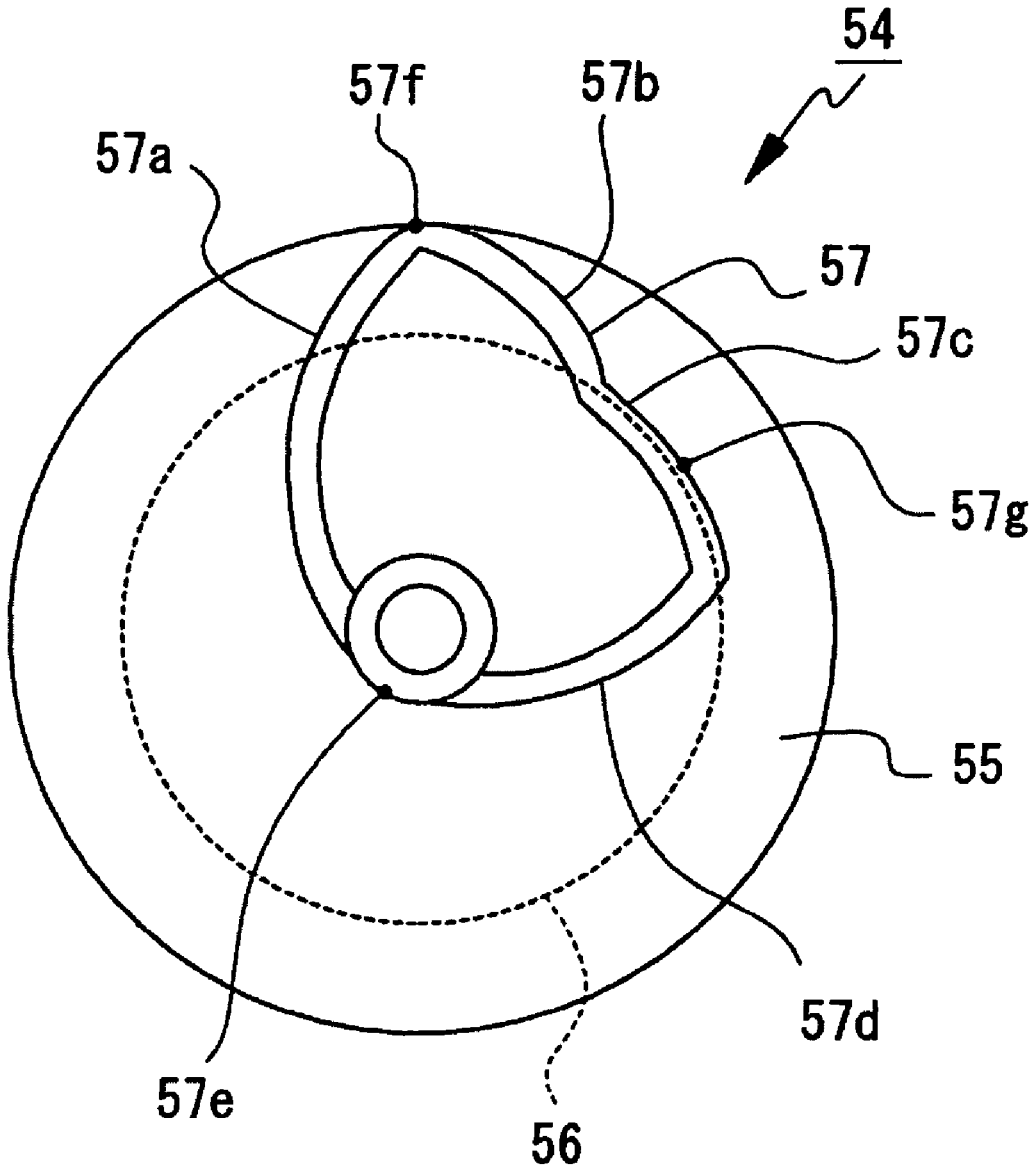
FIG. 23 is an enlarged side view of the cam.

The cam 54, as illustrated in FIGS. 20 and 23, is an integrated unit including a rotation disk 55, which faces the left and right direction, a gear 56, which is formed on the right surface of the rotation disk 55, and a cam protrusion 57, which is formed on the left surface of the rotation disk 55. The rotation disk 55 is rotatably supported at a supporting point in the center of the rotation disk 55 by the first placement plate 49.

The cam protrusion 57 is formed eccentrically on the rotation disk 55 (refer to FIG. 23) and includes a first cam section 57*a*, which is displaced from the substantial center of the rotation disk 55 to the periphery and is the longest cam, a second cam section 57*b*, which is connected to the first cam portion 57*a* and is gradually displaced to approach the center from the periphery of the rotation disk 55, a third cam section 57*c*, which is connected to the second cam section 57*b* and is gradually displaced to approach the center of the rotation disk 55 even more, and a fourth cam section 57*d*, which is connected to the third cam section 57*c* and the first cam section 57*a*.

In the cam protrusion 57, the intersection of the first cam section 57*a* and the fourth cam section 57*d* is a first working point 57*e*, the intersection of the first cam section 57*a* and the second cam section 57*b* is a second working point 57*f*, and the substantial center of the third cam section 57*c* is a third working point 57*g*.

On the second placement plate 50, which is interposed between the first placement plate 49 and the third placement plate 51, longitudinally elongated guide holes 50*a* and 50*a* are formed apart from each other at the front and the rear (refer to FIG. 20). On the second placement plate 50, a spring support member 58 and a cam sliding shaft 59 are formed apart from each other in the vertical direction between the guiding holes 50*a* and 50*a*. The spring support member 58 protrudes to the left and the cam sliding shaft 59 protrudes to the right. The cam sliding shaft 59 slides along the peripheral surface of the cam protrusion 57 of the cam 54.

Figure 24:
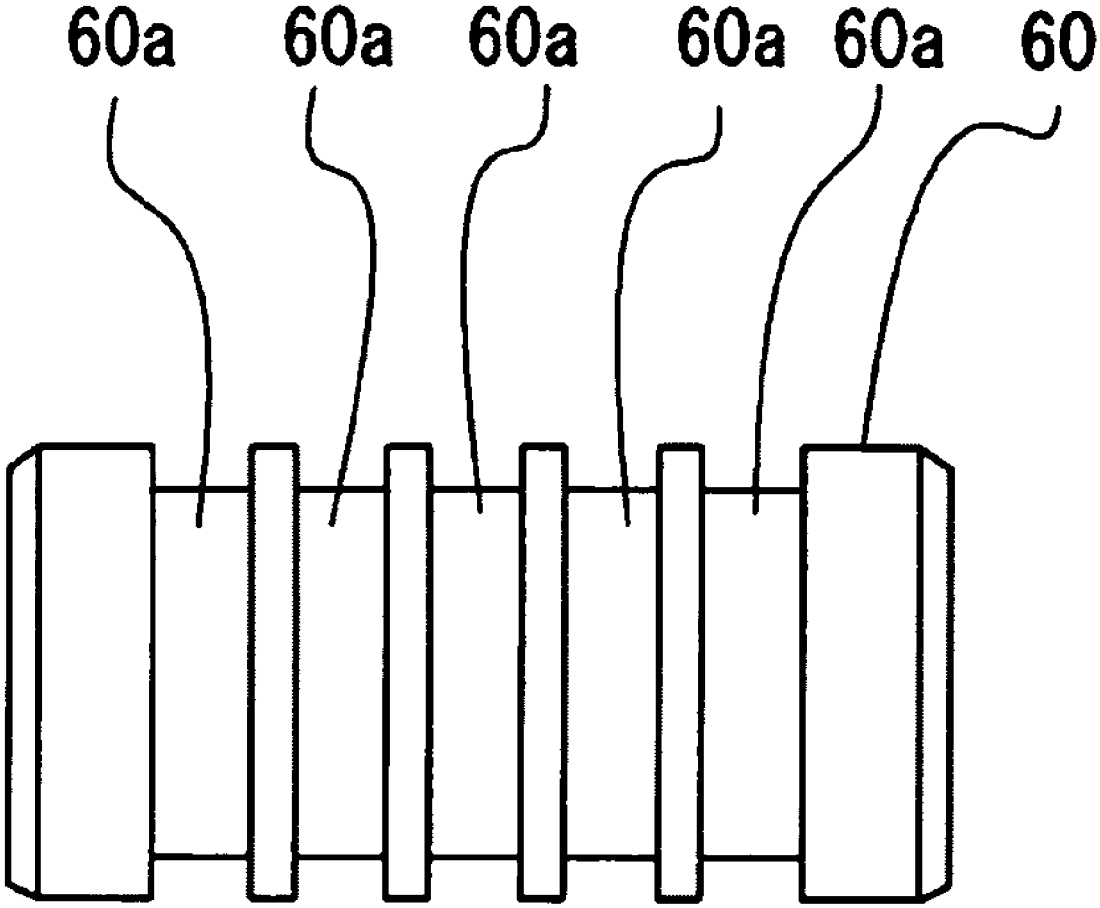
FIG. 24 is an enlarged front view of the roller.

On the forward and rear ends of the second placement plate 50, rollers 60 and 60 are rotatably supported. The rollers 60 and 60 rotate around a shaft extending to the left and right. As illustrated in FIG. 24, insertion grooves 60*a*,

60*a*, . . . are formed apart from each other at the left and the right around the periphery of the rollers 60 and 60. The rollers 60 and 60 are moveable in the vertical direction relative to the second placement plate 50 and are urged downward by urging means (helical compression springs) 61 and 61 (refer to FIG. 20).

The force of the springs of the urging means 61 and 61 is weak. As described later, the urging means 61 and 61 are compressed by the reactive force of the printing sheet 3000 when the rollers 60 and 60 press the printing sheet 3000.

In the middle of the front and the rear of the third placement plate 51, a longitudinally elongated guide hole 51*a* is formed. As illustrated in FIGS. 21 and 22, a spring support member 58 formed on the second placement plate 50 is passed through the guide hole 51*a*.

On the forward and rear ends of the third placement plate 51, guide pins 62 and 62 protruding to the right are formed. As illustrated in FIG. 20, the guide pins 62 and 62 pass through the guiding holes 50*a* and 50*a* of the second placement plate 50.

The upper ends of helical extension springs 63 and 63 are supported at the upper edge of the third placement plate 51 so that they are apart from each other at the front and the rear. The helical extension springs 63 and 63 are positioned on the left of the third placement plate 51 and are supported by the spring support member 58, whose lower portion passes through the guiding hole 51*a*.

Consequently, the second placement plate 50 and its components are urged upward by the helical extension springs 63 and 63, and the cam sliding shaft 59 is urged from below against the cam 54 and the cam protrusion 57.

The second placement plate 50 and its components are moved in the vertical direction as the position of the cam sliding shaft 59 relative to the cam protrusion 57 changes when the cam 54 is rotated (FIGS. 21 and 22). When the second placement plate 50 and its components are moved downward, the rollers 60 and 60 pass through the roller insertion holes 43*a* and 43*a*, which are formed on the first mechanism positioning region 43, and protrude downwards from the first mechanism positioning region 43.

Figure 25:
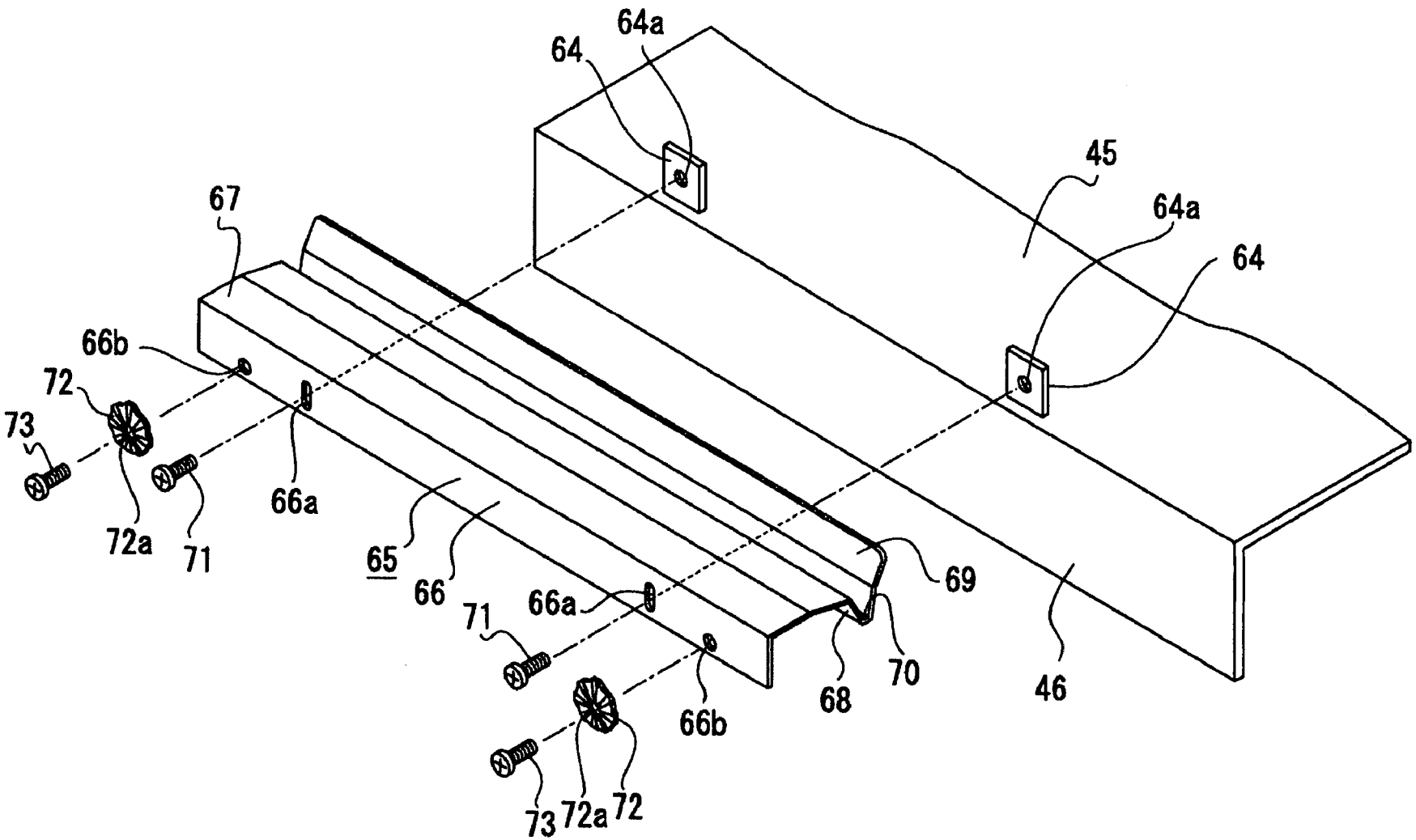
FIG. 25 is an enlarged perspective view illustrating the relationship between the receptive member and the second mechanism positioning region.
Figure 26:
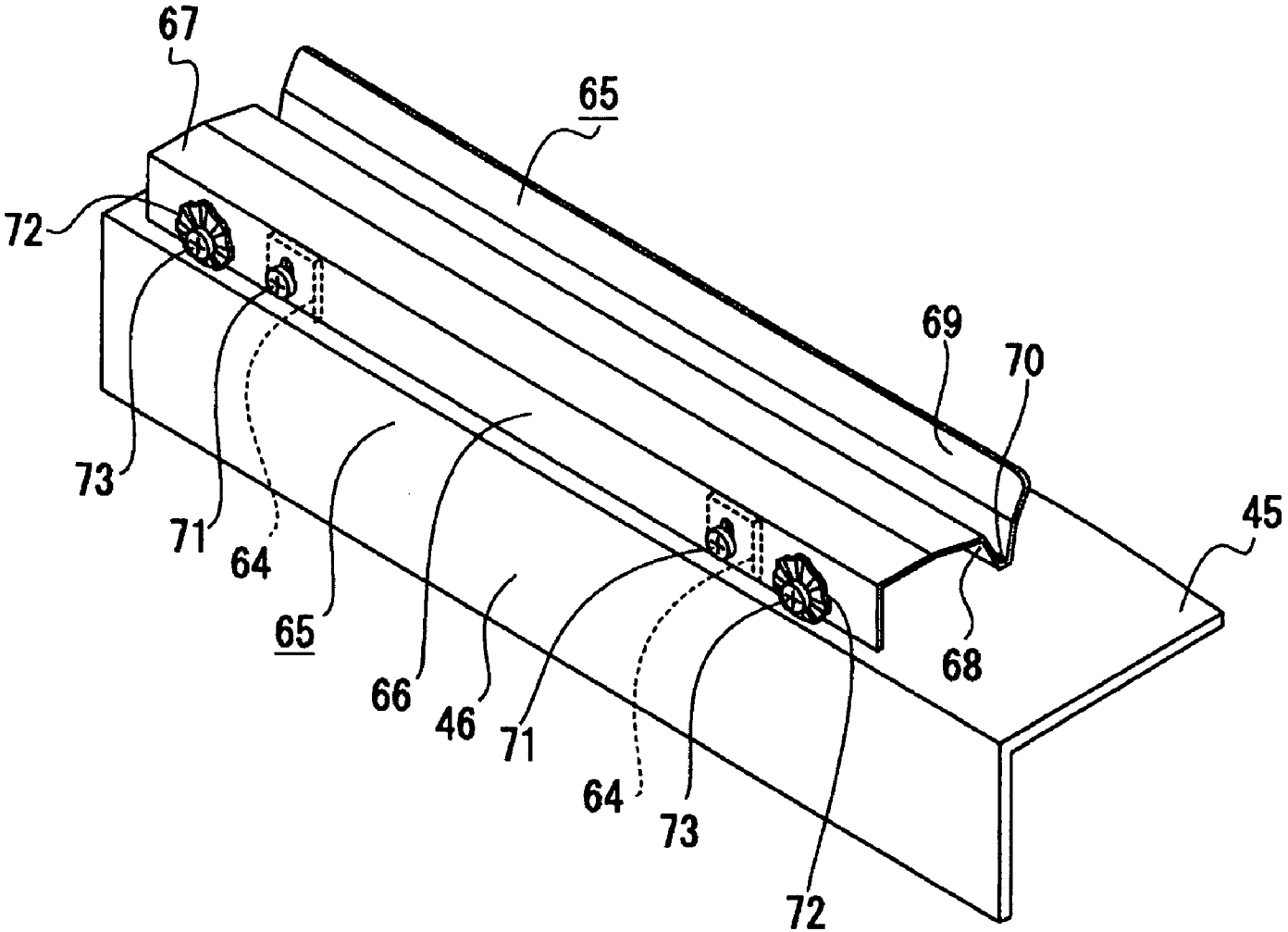
FIG. 26 is an enlarged perspective view illustrating the receptive member when attached to the second mechanism positioning region.

On the upper surface of the second mechanism positioning region 45, as illustrated in FIGS. 25 and 26, supporting pieces 64 and 64 are formed apart from each other at the left and the right. On the supporting pieces 64 and 64, attachment screw holes 64*a* and 64*a* are formed.

A receptive member 65 is attached to the supporting pieces 64 and 64. The receptive member 65 is formed by bending a plate extended from the front to the rear into a predetermined shape. The receptive member 65 is an integral unit including an attachment portion 66, which faces the left and right direction, a connecting portion 67, which protrudes rightward from the upper edge of the attachment portion 66, a first groove forming portion 68, which protrudes in the lower right direction from the right edge of the connecting portion 67, and a second groove forming portion 69, which protrudes to the upper right direction from the first groove forming portion 68. The first groove forming portion 68 and the second groove forming portion 69 form a V-shaped receptive groove 70.

On the attachment portion 66, elongated adjustment holes 66*a* and 66*a* are formed apart from each other at the front and the rear. Screw holes 66*b* and 66*b* are formed in front of and behind the outer sides of the adjustment holes 66*a* and 66*a*.

The receptive member 65 is attached by screwing attachment screws 71 and 71 passed through the adjustment holes 66*a* and 66*a* into the to the attachment screw holes 64*a* and 64*a* of the supporting pieces 64 and 64.

On the receptive member 65, adjustment plates 72 and 72 are attached. On each of the adjustment plates 72 and 72, a screw insertion hole 72*a* is formed. The distance from the center to the periphery of the screw insertion hole 72*a* differs around the circumference (refer to the enlarged view in FIG. 27). For example, the peripheral area of each of the adjustment plates 72 and 72 includes a first adjustment portion A, second adjustment portions B and B, third adjustment portions C and C, fourth adjustment portions D and D, and a fifth adjustment portion E, wherein the length measured from center of the screw insertion hole 72*a* decreases in sequence from A to E. The adjustment portions A, B, C, D, E, D, C, and B are disposed in this order around the periphery at equal intervals.

As illustrated in FIGS. 25 and 26, the adjustment plates 72 and 72 are attached to the receptive member 65 by screwing screws 73 and 73, which pass through the screw insertion holes 72*a* and 72*a*, into the screw holes 66*b* and 66*b* of the attachment portion 66.

In the printer 1, the position and angle of the receptive member 65 relative to the second mechanism positioning region 45 can be changed. According to this change, the position and angle of the receptive groove 70 relative to the rollers 60 and 60 change.

The position and angle of the receptive member 65 relative to the second mechanism positioning region 45 can be changed by loosening the attachment screws 71 and 71 to make the receptive member 65 moveable relative to the supporting pieces 64 and 64, by loosening the screws 73 and 73 and rotating the adjustment plates 72 and 72 so that the predetermined attachment portion A, B, B, C, C, D, D, or E, comes into contact with the upper surface of the second mechanism positioning region 45, and by retightening the attachment screws 71 and 71 and the screws 73 and 73.

Figure 27:
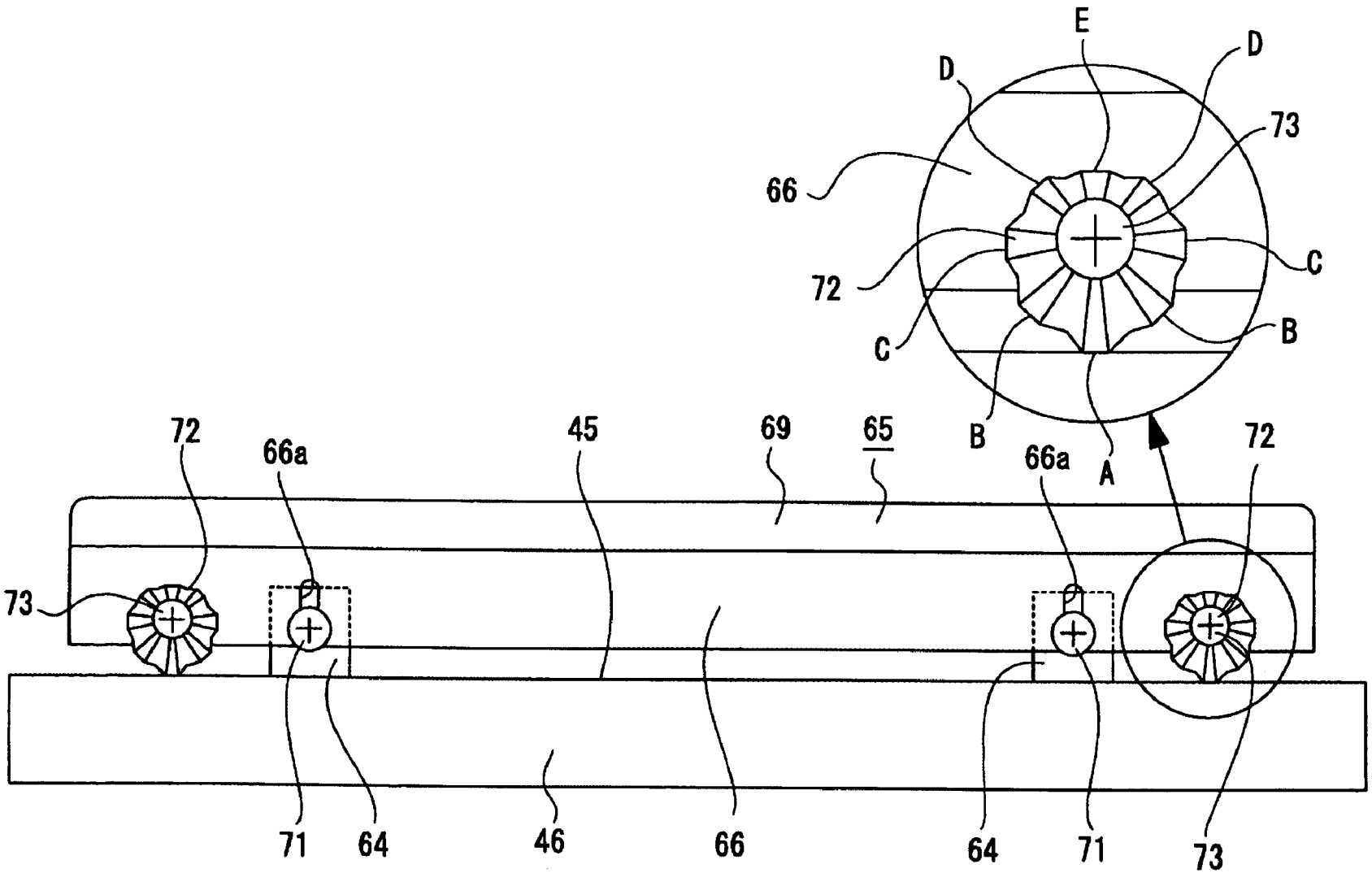
FIG. 27, together with FIGS. 28 and 29, illustrates the position adjustment of the receptive member performed by the adjustment plates and is an enlarged perspective view illustrating the receptive member when disposed apart from the second mechanism positioning region.

For example, as illustrated in FIG. 27, by bringing the first adjustment portions A and A of the adjustment plates 72 and 72 into contact with the upper surface of the second mechanism positioning region 45, the receptive member 65 can be attached to a position furthest from the second mechanism positioning region 45.

Figure 28:
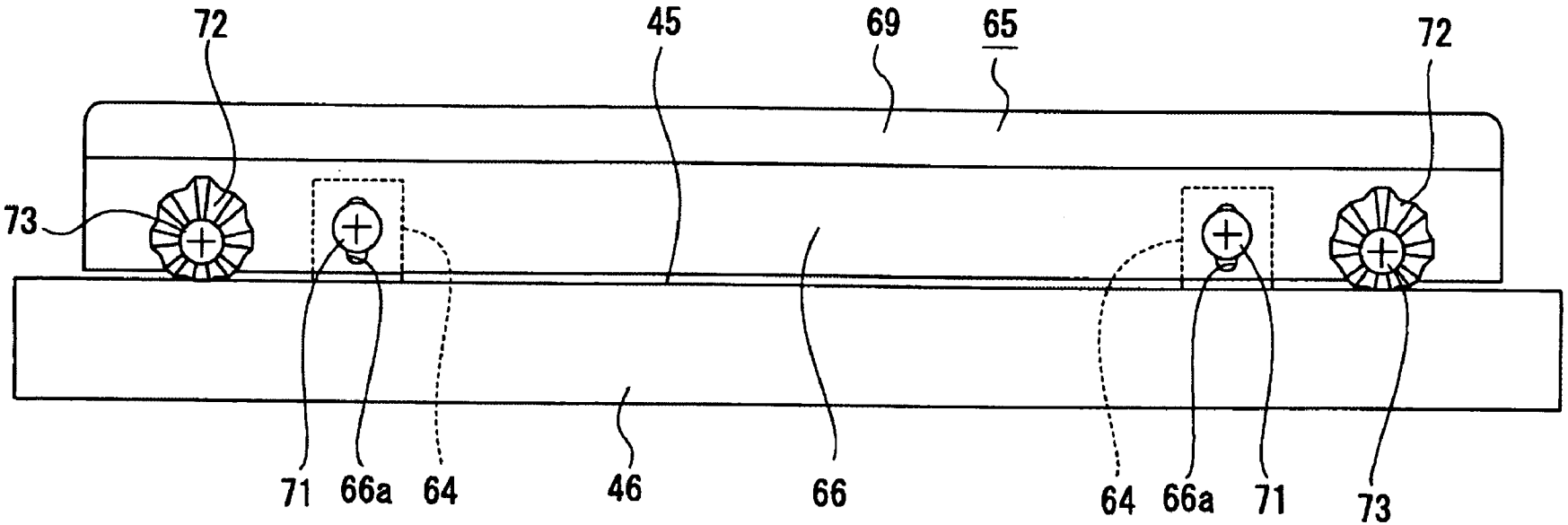
FIG. 28 is an enlarged perspective view illustrating the receptive member when disposed close to the second mechanism positioning region.

On the other hand, as illustrated in FIG. 28, by bringing the fifth adjustment portions E and E of the adjustment plates 72 and 72 into contact with the upper surface of the second mechanism positioning region 45, the receptive member 65 can be attached to the closest position of the second mechanism positioning region 45.

Figure 29:
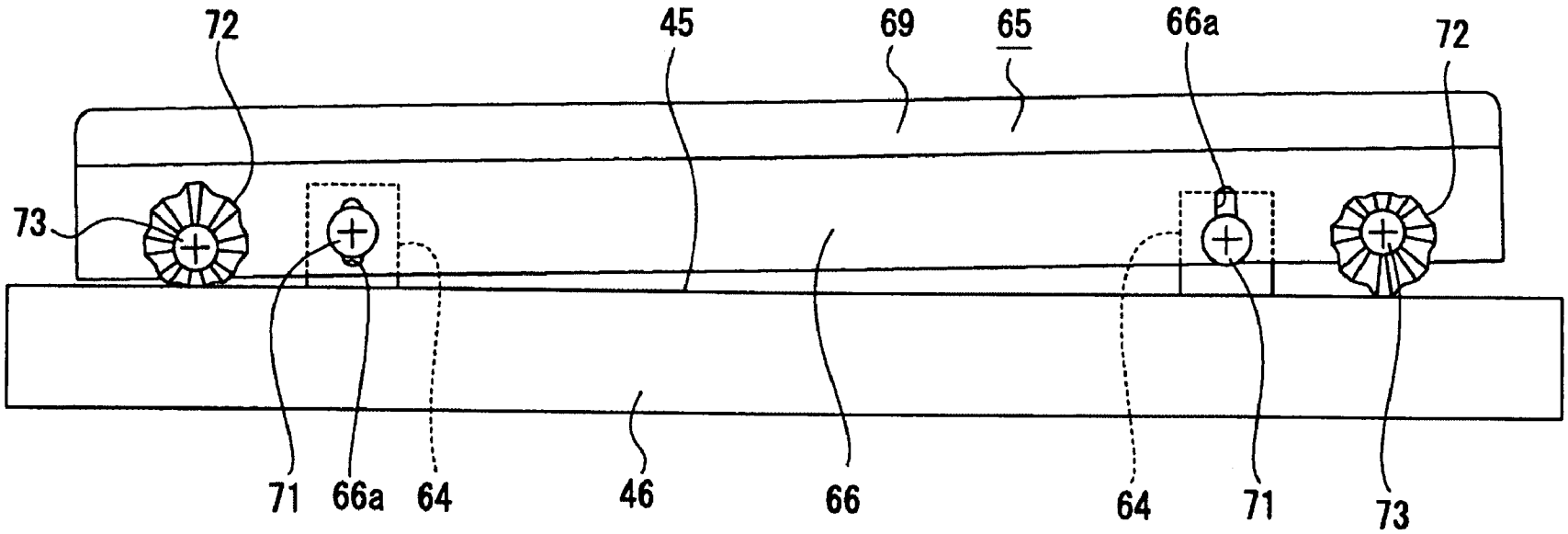
FIG. 29 is an enlarged perspective view illustrating the receptive member when disposed at an angle relative to the second mechanism positioning region.

As illustrated in FIG. 29, by bringing different adjustment portions of the adjustment plates 72 and 72 such as A and B, B and C, or B and D into contact with the upper surface of the second mechanism positioning region 45, the receptive member 65 can be attached at an oblique angle relative to the second mechanism positioning region 45.

Locking rollers 74 and 74 are disposed close to the front edges of the first mechanism positioning region 43 and the second mechanism positioning region 45 (refer to FIGS. 18 and 19). The locking roller 74 and 74, as illustrated in the enlarged view in FIG. 18, include shafts 74*a* and 74*a*, which are attached to the first mechanism positioning region 43 and the second mechanism positioning region 45, and rollers 74*b* and 74*b*, which are rotatably supported by the shafts 74*a* and 74*a*. The locking roller 74 disposed on the first mechanism positioning region 43 protrudes downward and the locking roller 74 disposed on the second mechanism positioning region 45 protrudes upward.

An inner cover 75 is attached to the supporting point shaft 47 supported between the first mechanism positioning region 43 and the second mechanism positioning region 45 (refer to FIGS. 18 and 19). The inner cover 75 is rotatably supported by the supporting point shaft 47 so that it pivots from the cover-open position to the cover-closed position.

The inner cover 75 is composed of, for example, magnetic metal and is an integral unit including a main surface 76, in which one of the ends is attached to the supporting point shaft 47, protrusions 77 and 77, which protrude upward and downward from the other end of the main surface 76, and spring supports 78 and 78, which protrude from the upper and lower edges of the protrusions 77 and 77 toward the outer cover 6. Each of the spring supports 78 and 78, as illustrated in FIGS. 30 and 31, includes an upper surface 78*a*, a lower surface 78*b*, and a side surface 78*c* opposing the protrusion 77.

Figure 30:
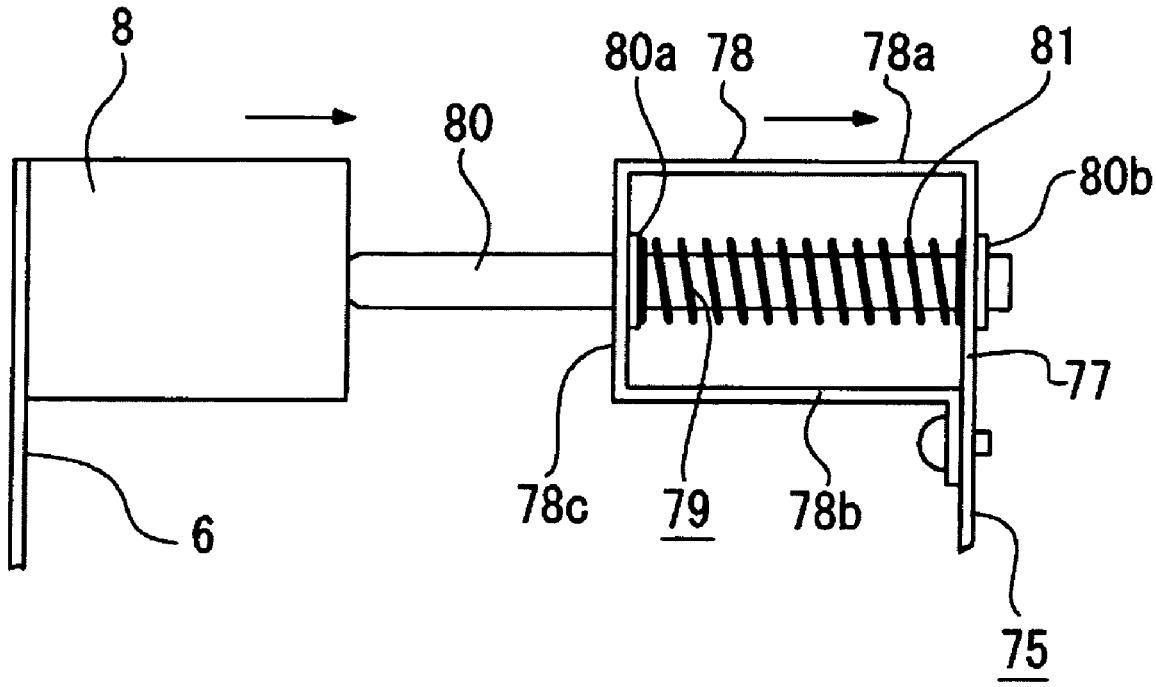
FIG. 30, together with FIG. 31, illustrates the movement of the working shaft when pressed by the pressing protrusion and is an enlarged front view illustrating the working shaft when in contact with the pressing protrusion.
Figure 31:
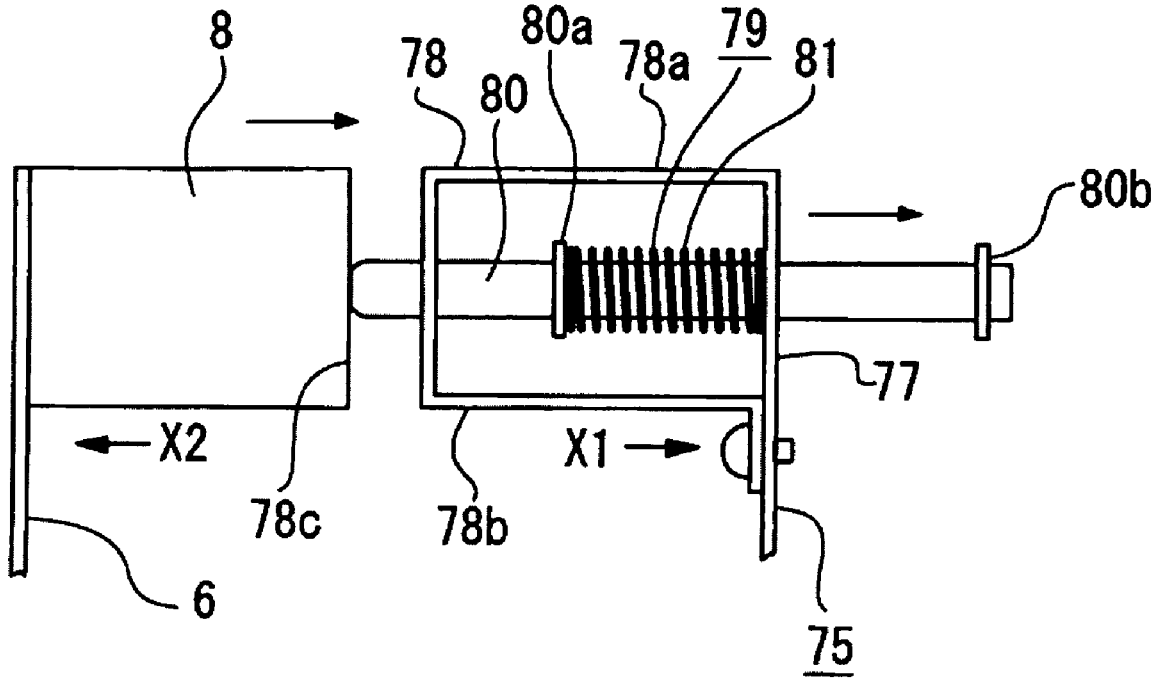
FIG. 31 is an enlarged front view illustrating the working shaft when pressed by the pressing protrusion and the helical compression spring when compressed.

On the spring supports 78 and 78, urging mechanisms 79 and 79 are disposed (refer to FIGS. 30 and 31). The urging mechanisms 79 and 79 include working shafts 80 and 80 and helical compression springs 81 and 81.

Each of the working shafts 80 and 80 passes through the protrusion 77 and the side surface 78*c* of the spring support 78. On each of the working shafts 80 and 80, fixing rings 80*a* and 80*b* are fixed apart from each other in the axial direction. The fixing ring 80*a* is fixed on the inner side of the side surface 78*c*, and fixing ring 80*b* is fixed on the outer side of the protrusion 77. Each of the helical compression springs 81 and 81 is compressed and is interposed between the fixing ring 80*a* and the protrusion 77. Consequently, each of the working shafts 80 and 80 is urged from the protrusion 77 to the side surface 78*c*.

The space between the above-mentioned outer cover 6 and the inner cover 75 of the chassis 2 is included in the positioning block 400. The space between the inner cover 75 and the base surface 42 of the chassis 41 is included in the intermediate delivery block 600. In the printer 1, if the printing sheet 3000 is jammed in any of these spaces, the jamming can be remedied by opening the outer cover 6 and, if necessary, the inner cover 75.

When the outer cover 6 and the inner cover 75 are both opened and the outer cover 6 is turned toward the cover-closed position, as illustrated in FIG. 30, the pressing protrusions 8 and 8 on the inner surface of the outer cover 6 press the working shafts 80 and 80 supported by the inner cover 75 toward the base surface 42.

As the working shafts 80 and 80 are pressed into the base surface 42 by the pressing protrusions 8 and 8, the inner cover 75 is turned toward the cover-closed position. When the inner cover 75 comes into contact with a restriction portion on the base surface 42, not depicted in the drawings, the turning of the inner cover 75 is restricted. At this time, the inner cover 75 is maintained in the cover-closed position by magnets on the chassis 41, not depicted in the drawings.

When the turning of the inner cover 75 is restricted as described above, the outer cover 6 can be turned further toward the cover-closed position. When the outer cover 6 is further turned, as illustrated in FIG. 31, the working shafts 80 and 80 are moved to the right against the force of the helical compression springs 81 and 81. The helical compression springs 81 and 81 are compressed as the working shafts 80 and 80 move to the right and urge the inner cover 75 toward the base surface 42 (direction X1 indicated in FIG. 31). At this time, the outer cover 6 is urged toward the cover-open position (direction X2 indicated in FIG. 31).

Figure 32:
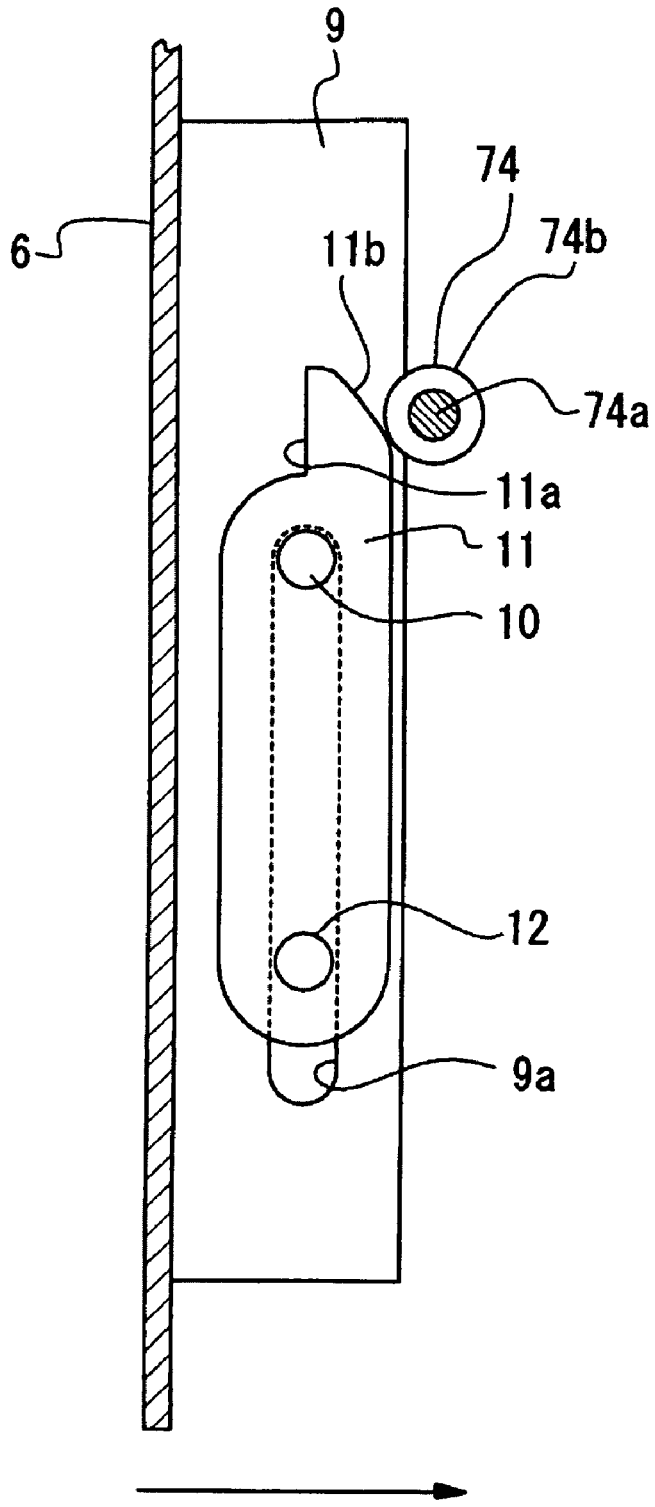
FIG. 32, together with FIGS. 33 and 34, illustrates the outer cover when locked to the chassis and is an enlarged plan view illustrating the locking member when in contact with the locking roller.
Figure 33:
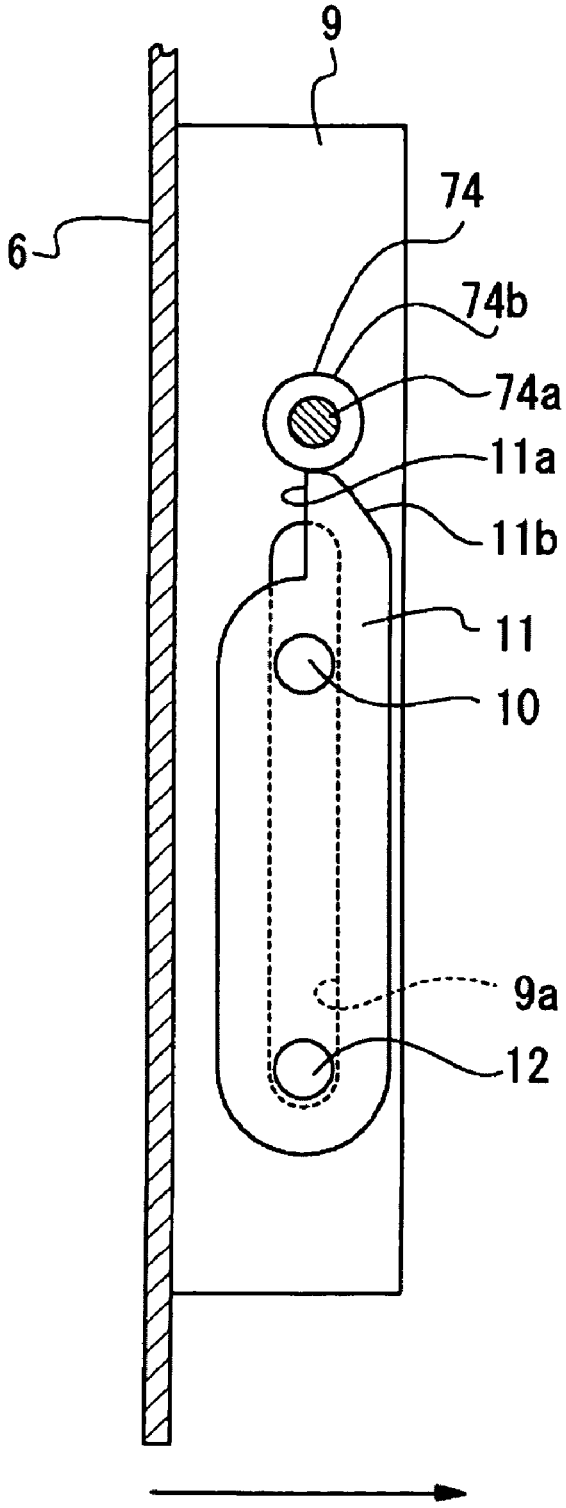
FIG. 33 is an enlarged plan view illustrating the locking member when moved forward.
Figure 34:
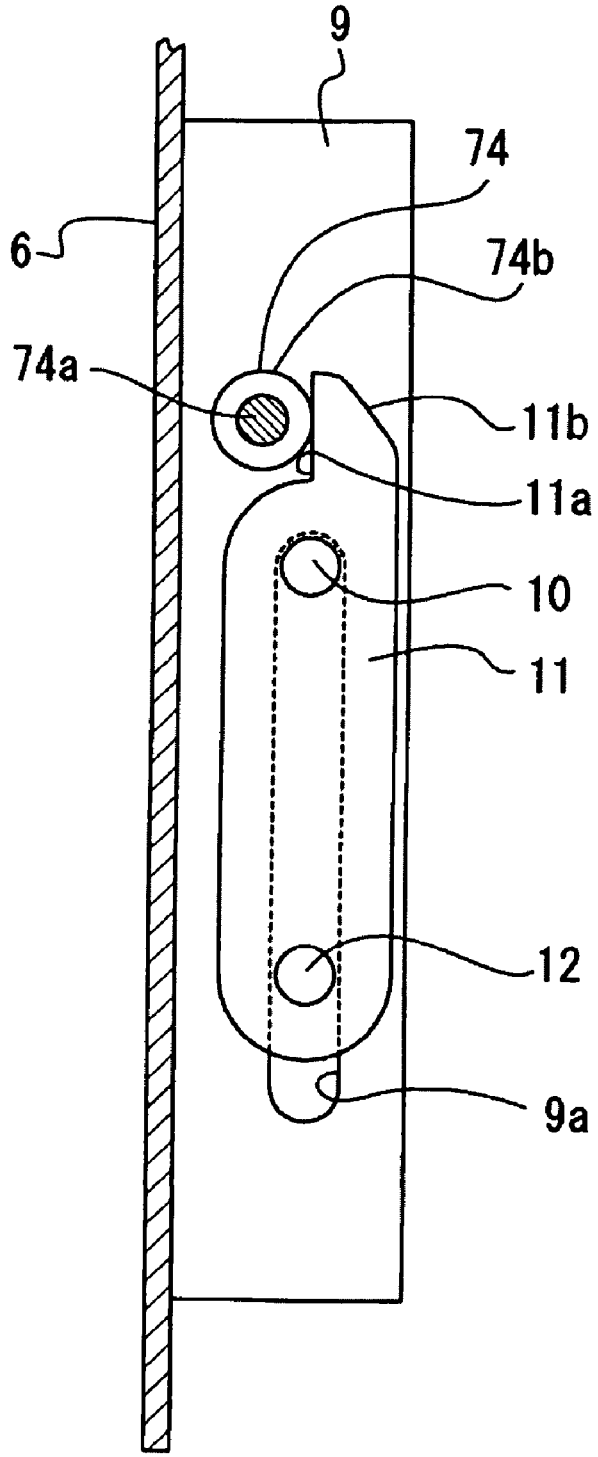
FIG. 34 is an enlarged plan view illustrating the locking member when engaged with the locking roller.

When the outer cover 6 is turned toward the cover-closed position, the inclined surfaces 11*b* and 11*b* of the locking members 11 and 11 come into contact with the rollers 74*b* and 74*b* of the locking roller 74 and 74 disposed on the chassis 41 (refer to FIG. 32). When the outer cover 6 is turned further toward the cover-closed position, as illustrated in FIG. 33, the locking members 11 and 11 move forward against the urging force of the springs disposed inside the supporting projections 9 and 9. At this time, the rollers 74*b* and 74*b* are rolled along the inclined surfaces 11*b* and 11*b*. When the outer cover 6 is turned even further, as illustrated in FIG. 34, the locking members 11 and 11 are moved backward by the urging force of the springs and the rollers 74*b* and 74*b* engage the locking notches 11*a* and 11*a* to lock the outer cover 6 to the cover-closed position.

On the other hand, the outer cover 6 is opened by holding the handle 6*a* and pulling it forward. By pulling the handle 6*a* forward, the locking members 11 and 11 are moved forward against the urging force of the springs. As described above, the outer cover 6 is urged toward the cover-closed position (direction X2 indicated in FIG. 31) by the urging mechanisms 79 and 79. Therefore, the helical compression springs 81 and 81 are extended and pressing projections 8 and 8 are pressed by the working shafts 80 and 80 to open the outer cover 6.

As described above, when the outer cover 6 of the printer 1 is turned toward the cover-closed position, the inner cover 75 is turned together with the outer cover 6 toward the cover-closed position and both of the covers are closed.

Consequently, the outer cover 6 and the inner cover 75 can be closed in one closing action. In this way, the closing action is simplified.

Since the inner cover 75 is held at the cover-closed position as it is urged towards the base surface 42 by the urging mechanisms 79 and 79 while the outer cover 6 is locked at the cover-closed position, the closed condition of the inner cover 75 is not released by the effects of vibration from the outside and/or vibration caused when each component is driven. In this way, the delivery of the printing sheet 3000 and/or the operation of each component are not negatively affected.

Moreover, the inner cover 75 is not opened while the outer cover 6 is locked at the cover-closed position. Thus, a troublesome procedure such as closing the inner cover 75 after once opening the outer cover 6 does not have to be carried out.

Furthermore, the magnetic force of the magnets does not have to be increased to close the inner cover 75. In this way, the opening of the inner cover 75 does not become difficult.

In addition, the opening of the outer cover 6 is performed by the urging force of the urging mechanisms 79 and 79 when the locking of the outer cover 6 is released. In this way, the opening of the outer cover 6 can be performed smoothly by simple actions.

When the printing sheet 3000 is delivered from the delivery block 300 to the positioning block 400, the printing sheet 3000 is positioned to a predetermined position at the positioning block 400.

The operation of positioning the printing sheet 3000 to a predetermined position is described below (refer to FIGS. 35 to 39).

When the printing sheet 3000 is delivered to the positioning block 400, the lower edge of the printing sheet 3000 is inserted into the receptive groove 70 of the receptive member 65. When the printing sheet 3000 is delivered to the positioning block 400, the printing sheet 3000 is detected by a sensor, not depicted in the drawings, and the delivery of the printing sheet 3000 is stopped.

Figure 35:
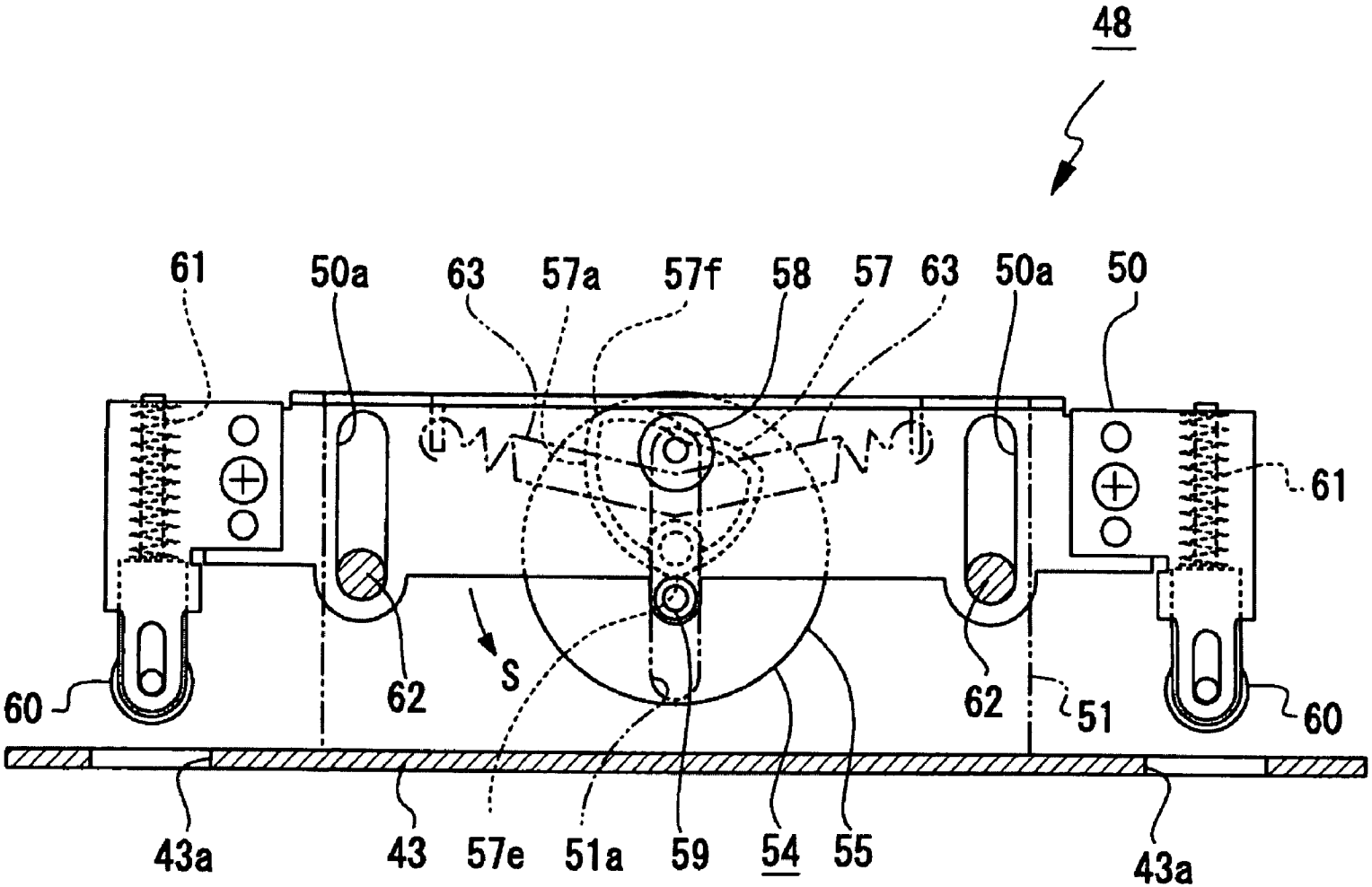
FIG. 35, together with FIGS. 36 to 39, illustrates the positioning of the printing sheet and is an enlarged side view including a partial cross-section view of the position changing mechanism before positioning is performed.

At this time, at the cam 54 of the position changing mechanism 48, the first working point 57*e* of the cam protrusion 57 is engaged with the cam sliding shaft 59 (refer to FIG. 35). Consequently, the rollers 60 and 60 are held at the upper edge of the moving range.

As described above, when the delivery of the printing sheet 3000 is stopped, the driving force of the actuating motor 52 is transmitted to the cam 54 via the gear group 53 and the cam 54 is turned in the direction S, indicated in FIG. 35. When the cam 54 is turned to the direction S, the first cam section 57*a* of the cam protrusion 57 is slid along the cam sliding shaft 59 and the cam sliding shaft 59 is moved downward against the spring force of the helical extension springs 63 and 63. Consequently, the rollers 60 and 60 are moved downward and protrude downward from the roller insertion holes 43*a* and 43*a* of the first mechanism positioning region 43.

Figure 36:
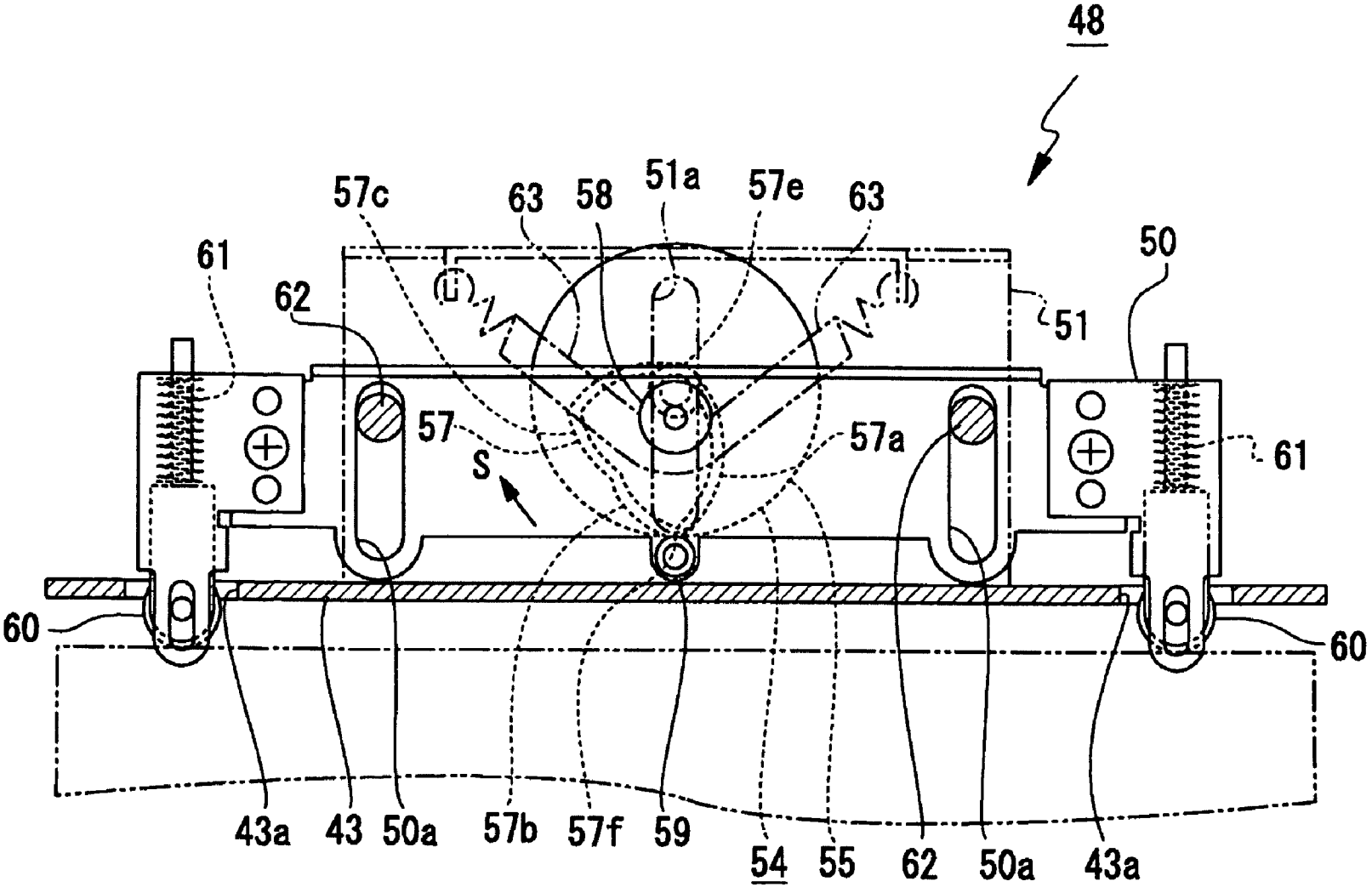
FIG. 36 is an enlarged side view including a partial cross-section of the printing sheet when pressed by the rollers with a strong force.

When the rollers 60 and 60 are moved downward, the upper edge of the printing sheet 3000 is inserted into the insertion grooves 60*a* and 60*a*, and the printing sheet 3000 is pressed downward by the rollers 60 and 60 (refer to FIG. 36).

By the rotation of the cam 54, the second working point 57*f* of the cam protrusion 57 is engaged with the cam sliding shaft 59 (refer to FIG. 36). When the second working point 57*f* of the cam protrusion 57 is engaged with the cam sliding shaft 59, the rollers 60 and 60 can move to the lower edge of the moving range. The urging means 61 and 61, however, are pressed to the utmost extent by the reactive force of the printing sheet 3000. Consequently, the printing sheet 3000 is pressed by the maximum pressing force of the rollers 60 and 60 at a first pressing position while the urging means 61 and 61 are not applying an urging force.

Figure 37:
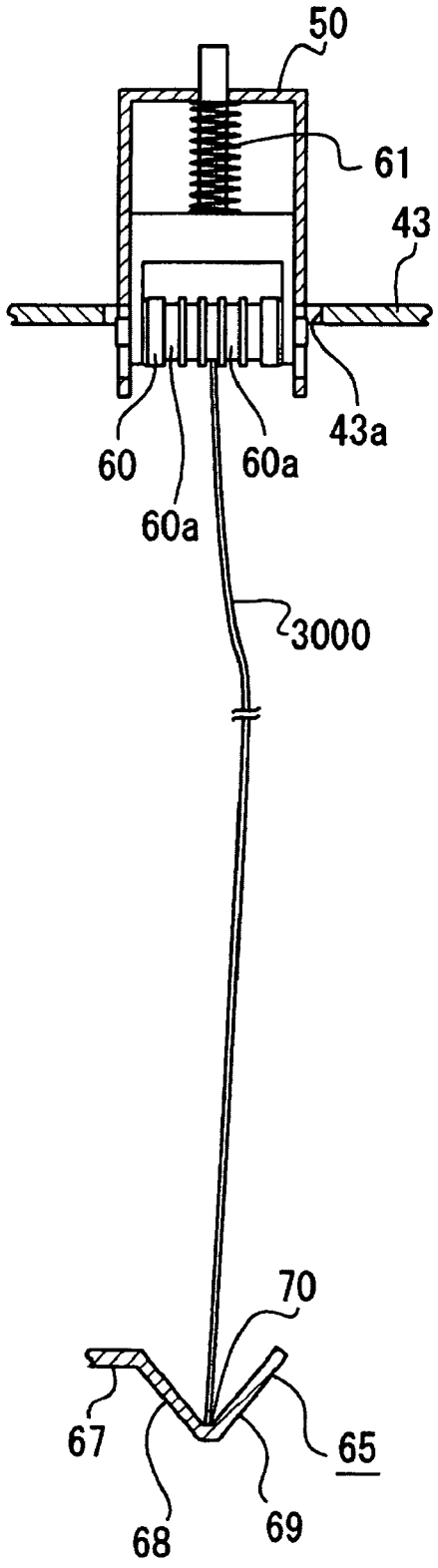
FIG. 37 is an enlarged front view including a partial cross-sectional view of the printing sheet when bent by being pressed by the rollers with a strong force.
Figure 38:
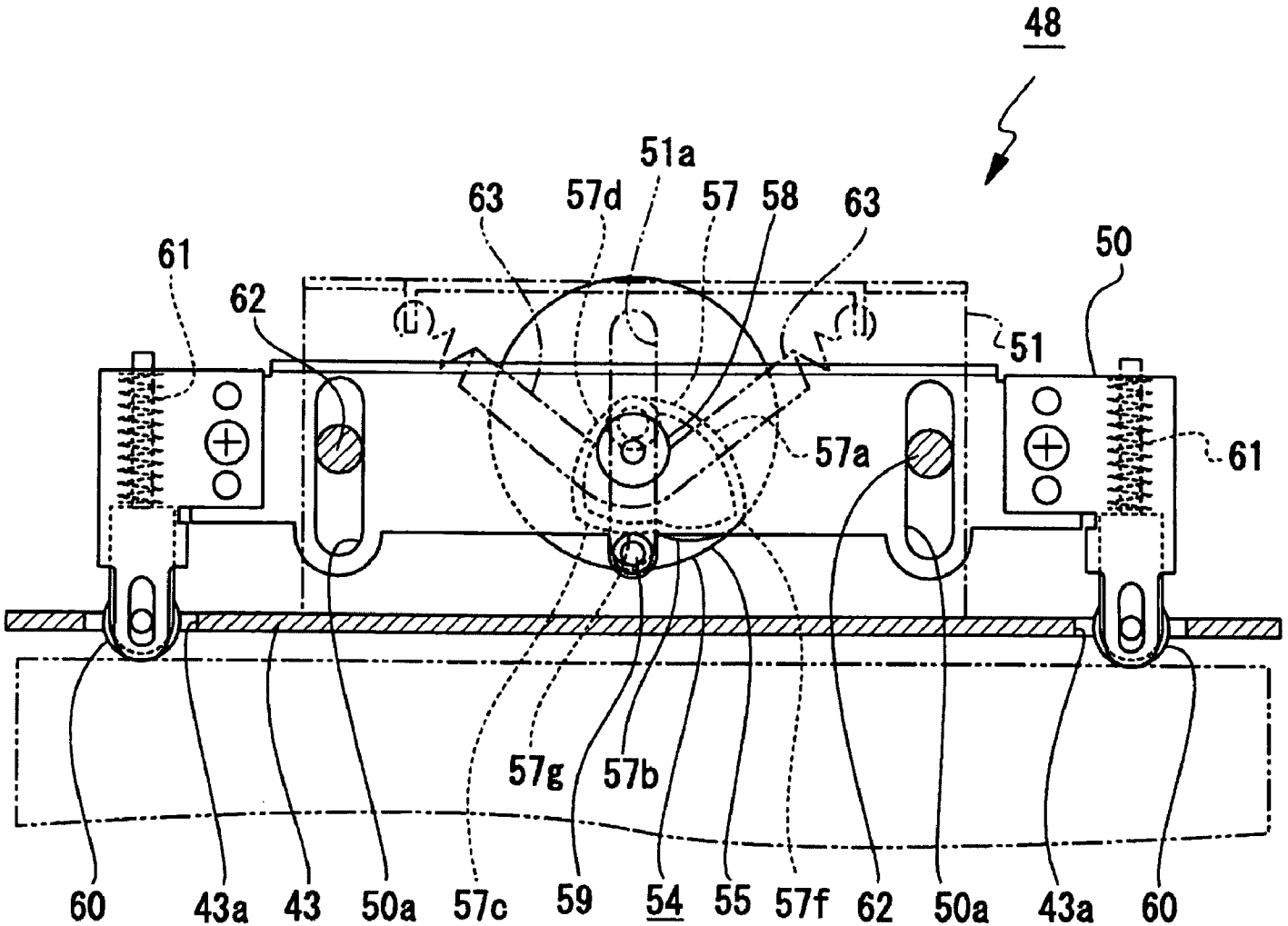
FIG. 38 is an enlarged side view including a partial cross-sectional view of the printing sheet when pressed by the rollers with a weak force.

When the printing sheet 3000 is pressed by the maximum pressing force of the rollers 60 and 60, the printing sheet 3000 is in a bended state (refer to FIG. 37). Consequently, the lower edge of the printing sheet 3000 is reliably pressed against the bottom surface of the receptive groove 70 of the receptive member 65.

The cam 54 is further rotated in the direction S, and the cam sliding shaft 59 is engaged with the third working point 57*g* of the third cam section 57*c* after passing the second cam section 57*b*. Then, the second placement plate 50 is raised together with the rollers 60 and 60 (refer to FIG. 38). When the cam sliding shaft 59 is engaged with the third working point 57*g*, the rotation of the cam 54 stops.

Figure 39:
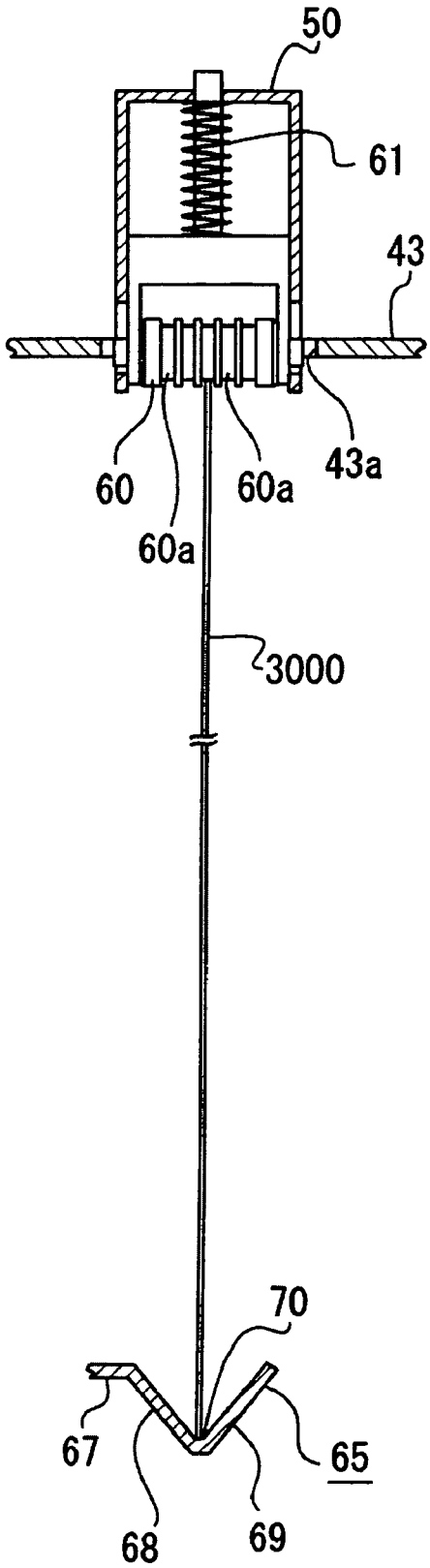
FIG. 39 is an enlarged front view including a partial cross-sectional view of the printing sheet when stretched out by being pressed by the rollers with a weak force.

When the second placement plate 50 is raised, the urging means 61 and 61 that were compressed to the compression limit are extended. Consequently, when the cam sliding shaft 59 is engaged with the third working point 57*g*, the urging means 61 and 61 are moderately compressed by the reactive force of the printing sheet 3000. The printing sheet 3000 is pressed by the rollers 60 and 60 at a second pressing position, as illustrated in FIG. 39, and the printing sheet 3000 is stretched into a plane as it is in contact with the rollers 60 and 60.

When the rotation of the cam 54 is stopped as the cam sliding shaft 59 is engaged with the third working point 57*g*, the delivery of the printing sheet 3000 is resumed and the printing sheet 3000 is delivered from the positioning block 400 to the printing block 500. When the printing sheet 3000 is delivered from the positioning block 400 to the printing block 500, the upper edge of the printing sheet 3000 is in contact with the rollers 60 and 60 and the lower edge is positioned at a predetermined position in contact with the bottom surface of the receptive groove 70. When the printing sheet 3000 is delivered, the rollers 60 and 60 are rotated as the printing sheet 3000 is delivered.

When the printing sheet 3000 is delivered to the printing block 500, the actuating motor 52 is rotated again and the cam 54 is rotated until the first working point 57*e* of the cam protrusion 57 engages with the cam sliding shaft 59.

As described above, in the printer 1, when the printing sheet 3000 is delivered to the positioning block 400 by the delivery block 300, the printing sheet 3000 is pressed by the rollers 60 and 60 with a strong force at the first pressing position. When the printing sheet 3000 is delivered from the positioning block 400 to the printing block 500, the printing sheet 3000 is pressed with a weak force by the rollers 60 and 60 at the second pressing position, which is further away from the receptive member 65 compared to the first pressing position.

Consequently, when the printing sheet 3000 is delivered from the delivery block 300 to the positioning block 400, the printing sheet 3000 is reliably positioned in a predetermined position. Moreover, since an excess pressing force is not applied to the positioned printing sheet 3000 when the printing sheet 3000 is delivered from the positioning block 400 to the printing block 500, jamming and/or bending of the printing sheet 3000 is prevented.

Since a predetermined pressing force is applied when the printing sheet 3000 is delivered, excellent positioning of the printing sheet 3000 can be maintained.

Moreover, since the rollers 60 and 60 are rotated along with the delivery of the printing sheet 3000 from the positioning block 400 to the printing block 500, the printing sheet 3000 is delivered smoothly.

Furthermore, since the printing sheet 3000 is delivered as the upper edge of the printing sheet 3000 is disposed into the insertion grooves 60*a* and 60*a* of the rollers 60 and 60, the printing sheet 3000 is not displaced in the thickness direction. Thus, the printing sheet 3000 is reliably delivered to the printing block 500.

As described above, in the printer 1, by changing the position and angle of the receptive member 65 relative to the second mechanism positioning region 45, the position and angle of the receptive groove 70 relative to the rollers 60 and 60 can be changed (refer to FIGS. 27 to 29).

By changing the position and angle of the receptive groove 70, the position of the printing sheet 3000 can be adjusted according to factors such as the magnitude of the urging force of the urging means 61 and 61 and the magnitude of the reactive force of the printing sheet 3000 generated when pressed by the rollers 60 and 60. Consequently, by changing the position and angle of the receptive groove 70, the position of the printing sheet 3000 is reliably determined.

Figure 6:
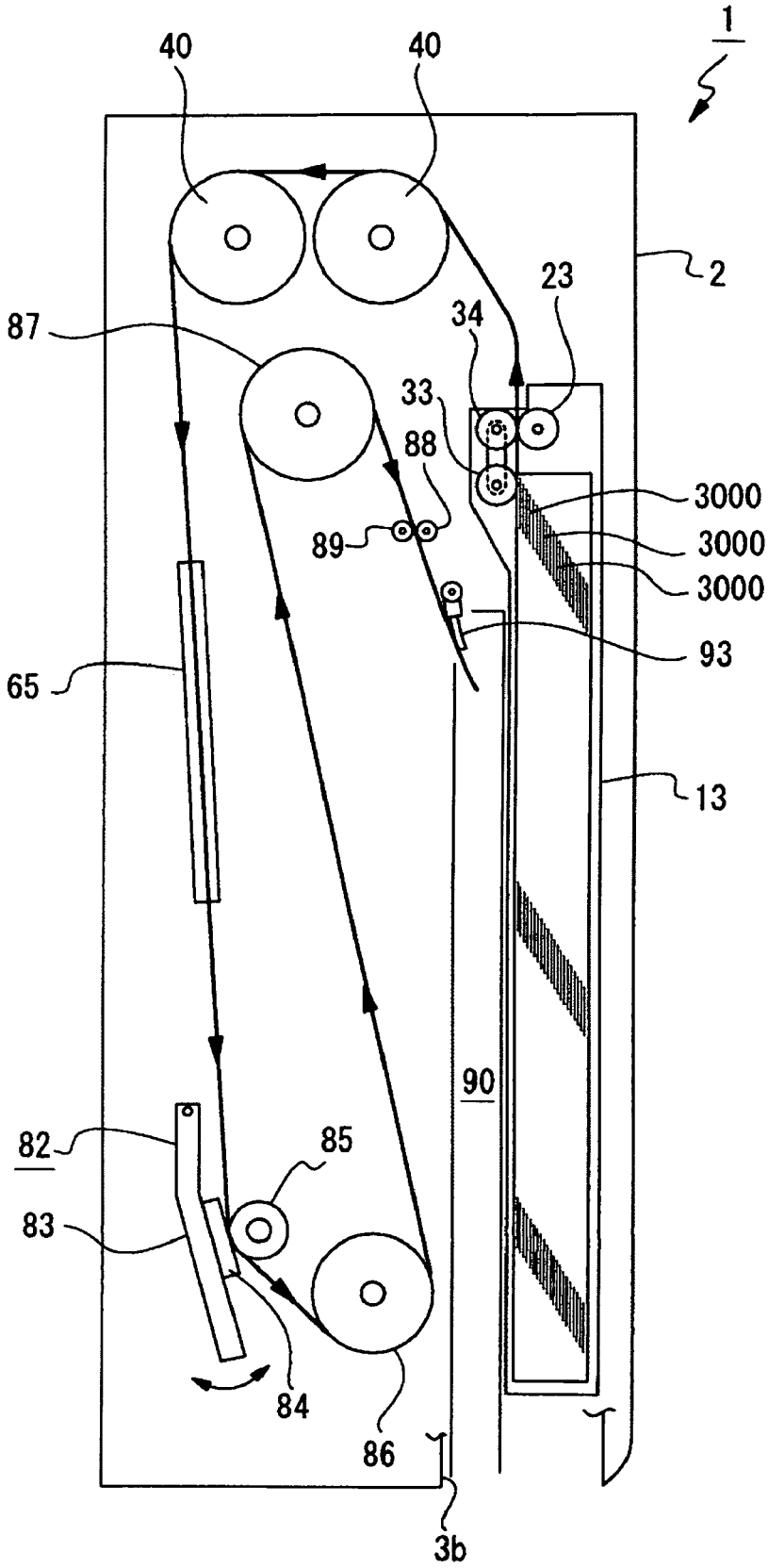
FIG. 6 is a schematic plan view of the inner structure of the printer.

The printing block 500 is disposed in front of the positioning block 400 (refer to FIG. 5) and includes a head mechanism 82 (refer to FIG. 6).

The head mechanism 82 is composed by forming a printing head 84 on a head support 83. The printing head 84 is a thermal head that prints on the printing sheet 3000 by thermal transfer.

A platen roller 85 is supported so that it opposes the printing head 84 of the head mechanism 82. The head mechanism 82 is rotatable in the direction away from the platen roller 85 by a head driving mechanism, not depicted in the drawings. When printing on the printing sheet 3000, the head support 83 is turned and the head mechanism 82 is pressed against the platen roller 85 with the printing sheet 3000 interposed between the head mechanism 82 and the platen roller 85. When printing is not performed, the head support 83 is turned in the opposite direction and the printing head 84 disconnects from the platen roller 85.

In the vicinity of the platen roller 85, a first reversal roller 86 is supported (refer to FIG. 6). In the printing block 500, the delivery direction of the printing sheet 3000 on which an image has been printed is reversed by the first reverse roller 86 to deliver the printing sheet 3000 to the intermediate delivery block 600.

The intermediate delivery block 600 is disposed behind the printing block 500 and on the right of the positioning block 400 (refer to FIG. 5). As described above, the intermediate delivery block 600 includes the space between the inner cover 75 and the base surface 42 of the chassis 41. Consequently, the printing sheet 3000 is delivered to the density measurement block 700 through the space between the inner cover 75 and the base surface 42.

The density measurement block 700 is disposed behind the intermediate delivery block 600 (refer to FIG. 5). In the density measurement block 700, a density measurement unit, not depicted in the drawings, for measuring the printing density of the delivered printing sheet 3000 is disposed.

In the density measurement block 700, a second reversal roller 87 is supported. The delivery direction of the printing sheet 3000 of which density measurement has been performed by the density measuring unit is reversed by the second reversal roller 87, and the printing sheet 3000 is delivered to the sheet discharge block 800.

The sheet discharge block 800 is disposed in front of the density measurement block 700 (refer to FIG. 5) and includes a discharge roller 88, which discharges the printing sheet 3000, and a feeding roller 89, which is pressed against the discharge roller 88 (refer to FIG. 6).

The sheet discharge block 800 is disposed at the left of the sheet storage block 100 (refer to FIG. 5). The sheet discharge block 800 has a sheet ejecting space 90 for ejecting the printing sheet 3000 discharged by the discharge roller 88 (refer to FIGS. 5 and 6).

Figure 40:
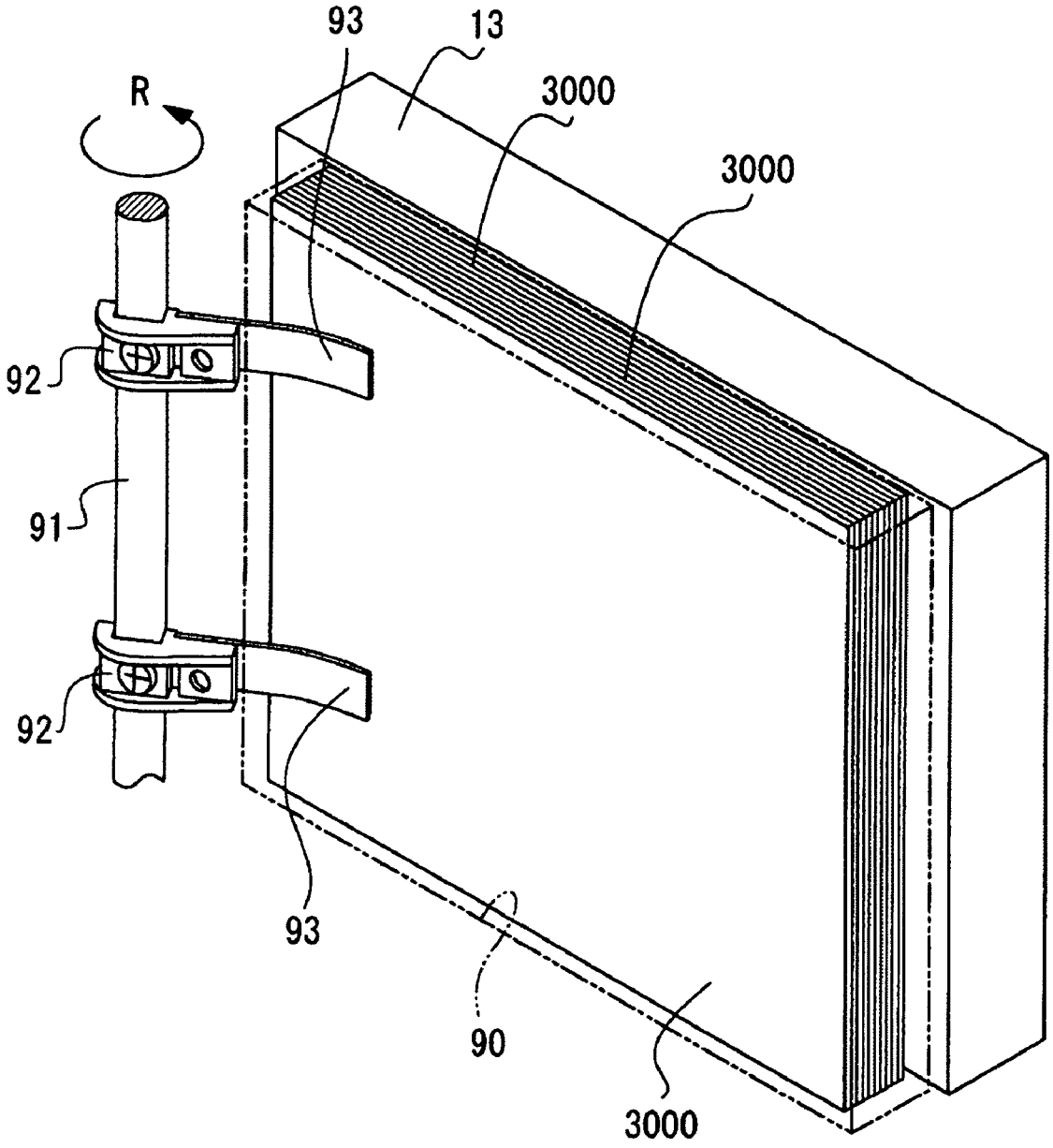
FIG. 40 is a perspective view of the sheet pressing members and the components in the vicinity.

The sheet discharge block 800, as illustrated in FIG. 40, includes a rotary shaft 91, supports 92 and 92, which are fixed to the rotary shaft 91, and sheet pressing members 93 and 93, which are attached to the supports 92 and 92.

The rotary shaft 91 is disposed so that the axial direction is the vertical direction. The supports 92 and 92 are disposed on the rotary shaft 91 so that they are apart from each other in the axial direction. The rotary shaft 91 is disposed immediately left of the rear edge of the storage tray 13 disposed inside the slot 3*b*.

The sheet pressing members 93 and 93 are composed of an elastic material such as rubber and are flat and elongated in one direction. One of the edges of the sheet pressing members 93 and 93 is attached to the supports 92 and 92, and the other edge protrudes from the supports 92 and 92.

Figure 41:
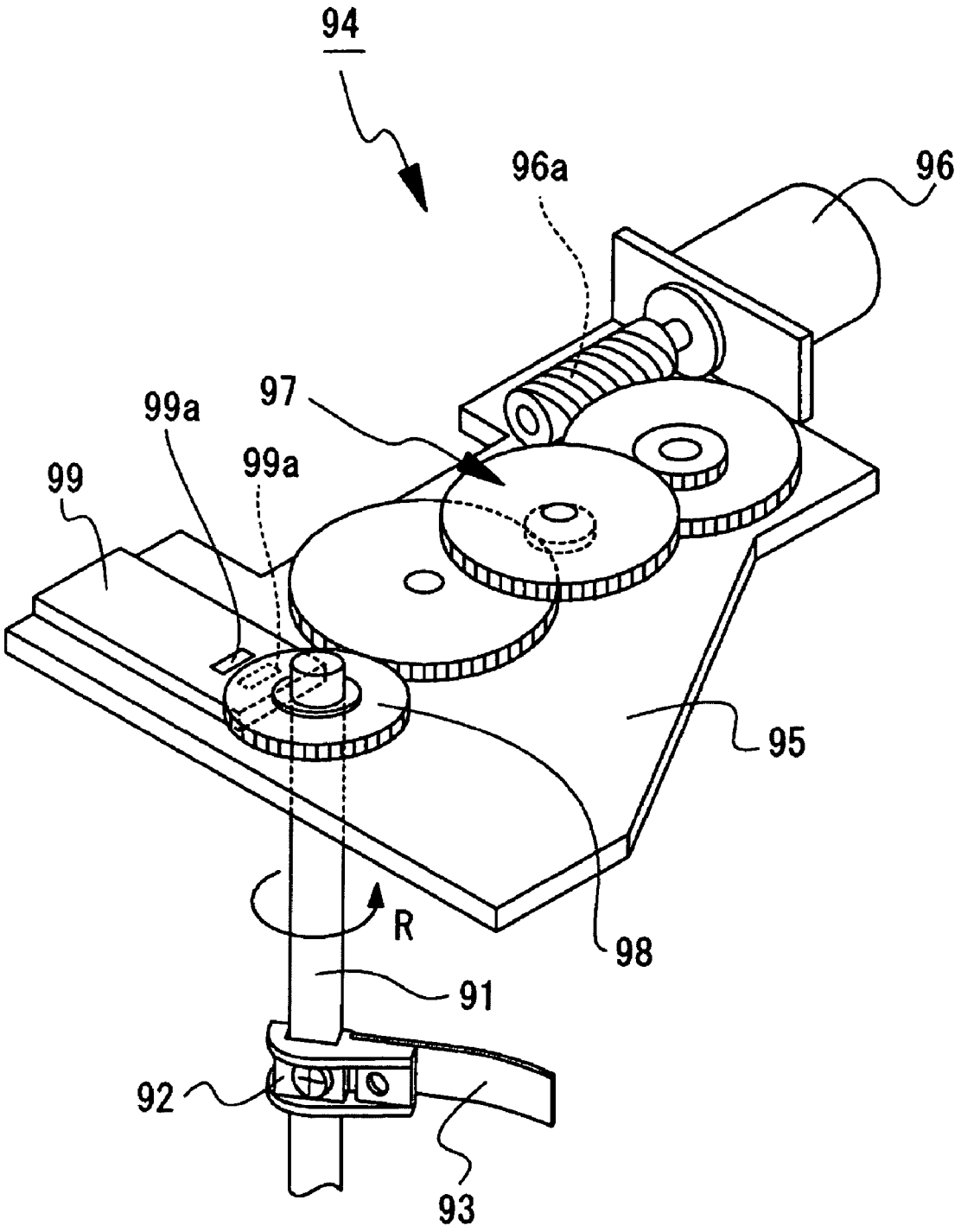
FIG. 41 is a perspective view of the rotation driving mechanism.

The rotary shaft 91 is rotated by a rotation driving mechanism 94, illustrated in FIG. 41. As the rotary shaft 91 rotates, the supports 92 and 92 and the sheet pressing members 93 and 93 are rotated. The rotation driving mechanism 94 includes a rotation driving motor 96, attached to a support chassis 95, a deceleration rear group 97, which is supported by the support chassis 95, a rotary shaft gear 98, which is also supported by the support chassis 95, and a sensor base 99, which is displaced on the support chassis 95.

On the motor shaft of the rotation driving motor 96, a worm 96*a* is fixed. The worm 96*a* is engaged with the deceleration gear group 97.

The rotary shaft gear 98 is engaged with the deceleration gear group 97 and has a detecting element, not depicted in the drawings, on the lower surface. The upper edge of the rotary shaft 91 is fixed to the center of the rotary shaft gear 98.

On one edge of the sensor base 99, light detecting elements 99*a* and 99*a* are disposed apart from each other at the left and the right. The side of the sensor base 99 having the light detecting elements 99*a* and 99*a* is disposed under the rotary shaft gear 98. Consequently, when the rotary shaft gear 98 is rotated, the detecting element of the rotary shaft gear 98 is detected by the light detecting elements 99*a* and 99*a*. In this way, the rotational position of the rotary shaft gear 98 is identified. When the rotational position of the rotary shaft gear 98 is identified, the results are sent to the rotation driving motor 96, and the rotation driving motor 96 is controlled to rotate or stop the rotary shaft gear 98.

In the rotation driving mechanism 94, when the rotation driving motor 96 is rotated, the driving force is transmitted to the worm 96*a*, the deceleration gear group 97, and the rotary shaft gear 98, in this order. The rotary shaft 91 fixed to the rotary shaft gear 98 is rotated in the direction R, indicated in FIGS. 40 and 41.

Figure 42:
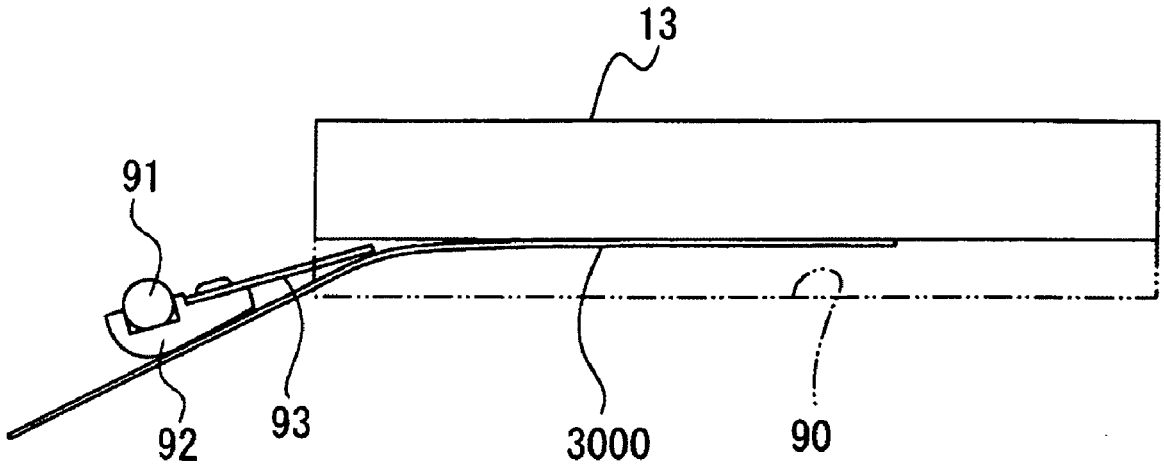
FIG. 42, together with FIGS. 43 to 47, illustrates the movement of the sheet pressing members and is a plan view illustrating the printing sheet being guided and discharged when the sheet pressing members are at the discharge position.

When the printing sheet 3000 is delivered from the density measurement block 700 to the sheet discharge block 800, the delivered printing sheet 3000 is discharged to a predetermined discharge position in the sheet ejecting space 90 of the sheet discharge block 800. At this time, the sheet pressing members 93 and 93 are in the discharge position in which the sheet pressing members 93 and 93 are extended along the discharge path. As illustrated in FIG. 42, the printing sheet 3000 is guided by the sheet pressing members 93 and 93 and is discharged into the sheet ejecting space 90. The discharge position of the sheet pressing members 93 and 93 is, for example, a position in which the end of the sheet pressing members 93 and 93 are adjacent to the storage tray 13 and are tilted relative to the storage tray 13.

Figure 43:
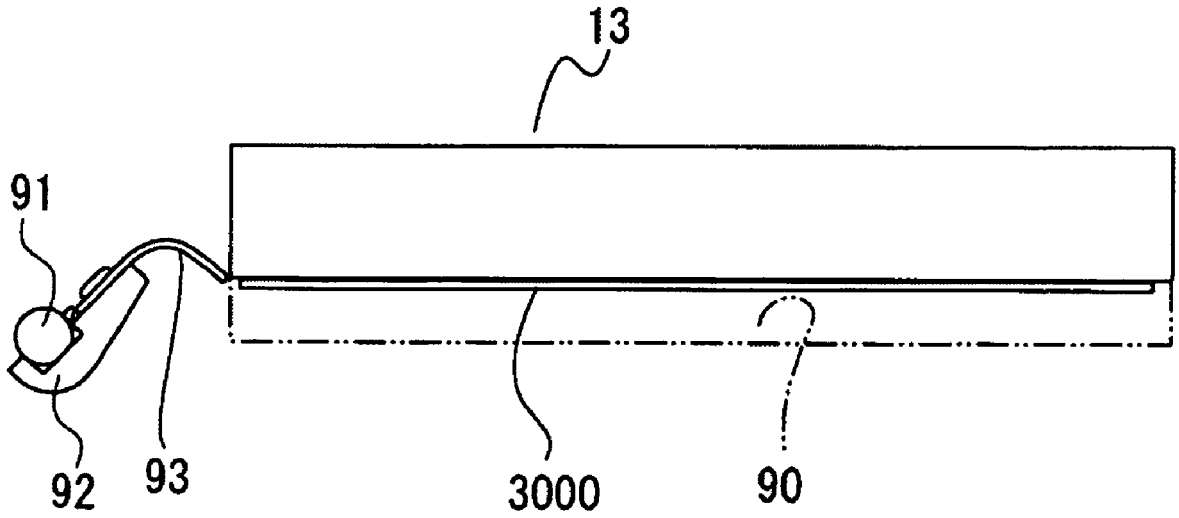
FIG. 43 is a plan view illustrating the sheet pressing members when rotated and coming into contact with the storage tray.

When the printing sheet 3000 is discharged into the sheet ejecting space 90, sheet detecting means, not depicted in the drawings, detects that the printing sheet 3000 has been discharged and the sheet pressing members 93 and 93 are rotated as the rotary shaft 91 is rotated. One of the ends of the rotated sheet pressing members 93 and 93 come into contact with the storage tray 13. Since the sheet pressing members 93 and 93 are composed of an elastic material, the sheet pressing members 93 and 93 are rotated while they are elastically deformed and in contact with the storage tray 13 (refer to FIG. 43).

Figure 44:
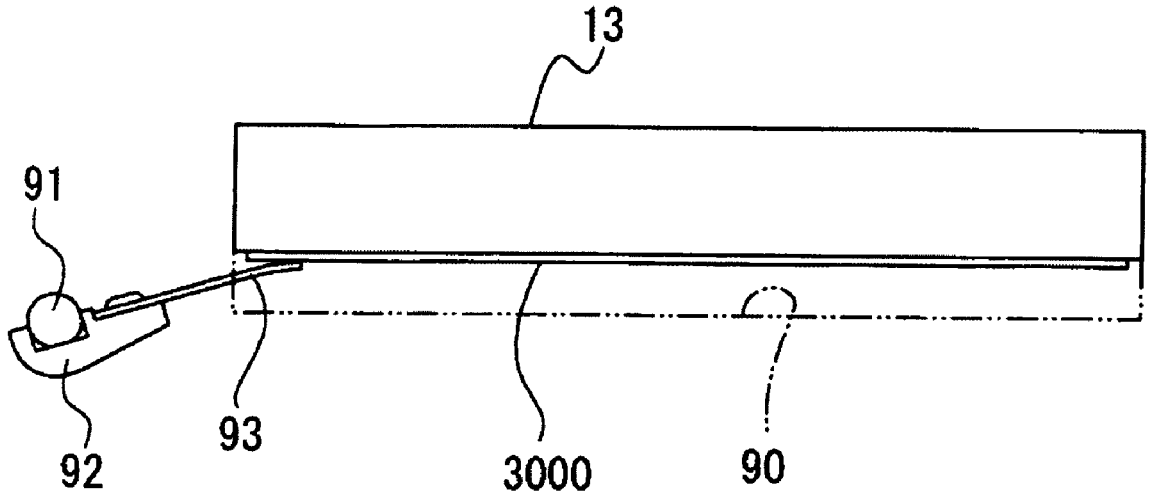
FIG. 44 is a plan view illustrating the printing sheet when pressed down by the sheet pressing members.

The sheet pressing members 93 and 93 are rotated further to make a full turn and are then stopped at a pressing position where the discharged printing sheet 3000 can be pressed down (refer to FIG. 44). The printing sheet 3000 is pressed against the storage tray 13 by the sheet pressing members 93 and 93. Since the sheet pressing members 93 and 93 are composed of an elastic material, the printing sheet 3000 pressed down by the sheet pressing members 93 and 93 is not damaged. The pressing position of the sheet pressing members 93 and 93 is the same position as the above-mentioned discharge position.

Figure 45:
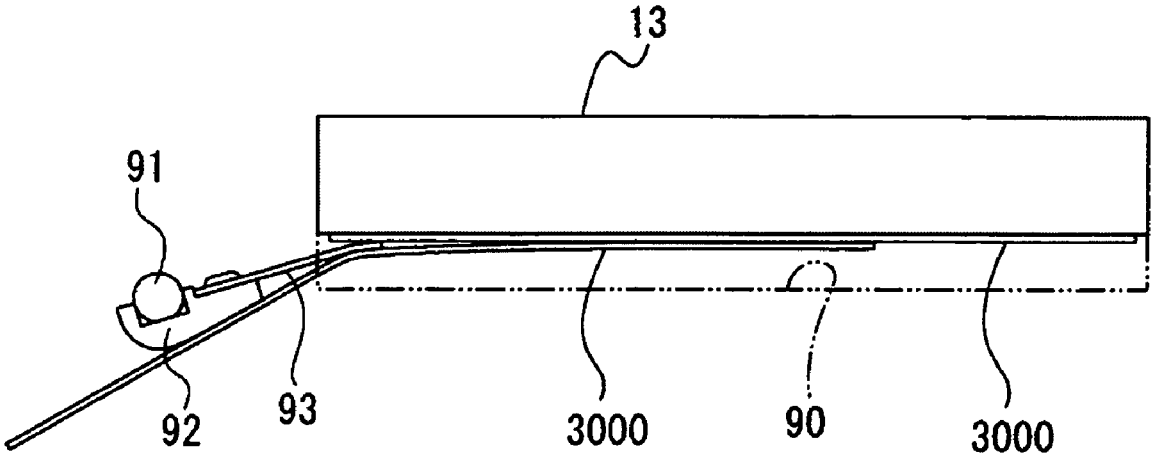
FIG. 45 is a plan view illustrating the printing sheet when pressed down by the sheet pressing members and the next printing sheet being discharged.

Subsequently, when the printing sheet 3000 is delivered from the density measurement block 700 to the sheet discharge block 800, the delivered printing sheet 3000 is guided by the sheet pressing members 93 and 93 at the pressing position (discharge position) and is discharged to the sheet ejecting space 90 (refer to FIG. 45).

The printing sheet 3000 passes by the other side of the sheet pressing members 93 and 93 compared to the previous printing sheet 3000 being pressed down by the sheet pressing members 93 and 93 and is discharged. Consequently, the discharge path of the printing sheet 3000 is the other side of the sheet pressing members 93 and 93 compared to the pressed down previous printing sheet 3000.

When the printing sheet 3000 is discharged into the sheet ejecting space 90, the sheet pressing members 93 and 93 are rotated again as the rotary shaft 91 rotates. The stack of printing sheets 3000 and 3000 is pressed down by the sheet pressing members 93 and 93 stopped at the pressing position.

Figure 46:
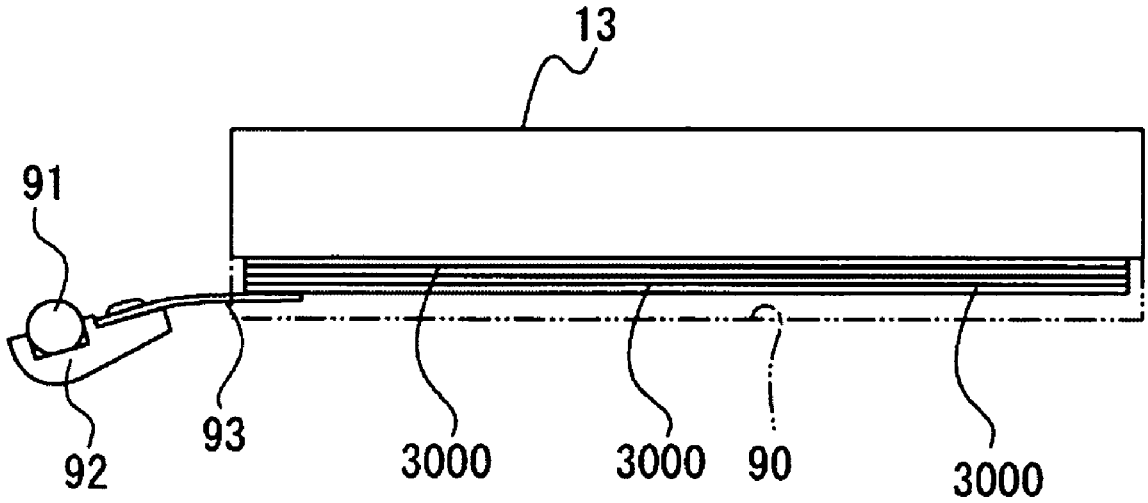
FIG. 46 is a plan view illustrating all the printing sheets when pressed down by the sheet pressing members.

Subsequently, the sheet pressing members 93 and 93 press down the printing sheets 3000, 3000, . . . until the discharge of the printing sheet 3000, 3000 . . . is completed. The sheet pressing members 93 and 93 press down every printing sheets 3000, 3000, . . . discharged into the sheet ejecting space 90 (refer to FIG. 46).

In the above-mentioned printer 1, the sheet pressing members 93 and 93, composed of an elastic material, for pressing down every discharged printing sheet 3000 by making a full turn as the rotary shaft 91 rotates are disposed. Therefore, when the printing sheets 3000, 3000, . . . are discharged into the sheet discharge block 800, it is difficult for space to form between the discharged printing sheets 3000, 3000, . . . that would cause warping and/or bending. Furthermore, even if the printing sheets 3000, 3000, . . . are warped or bent, the discharge path of the printing sheet 3000 is on the opposite side of the sheet pressing members 93 and 93 compared to the printing sheet 3000 already being pressed down and every discharged printing sheet 3000 is stacked in order; thus, the user will not mistake the discharge order.

Since discharged printing sheets 3000, 3000, . . . are pressed down by the sheet pressing members 93 and 93 without warping and/or bending, failure of discharge or jamming of the printing sheets 3000, 3000, . . . can be prevented.

Since the printing sheets 3000, 3000, . . . to be discharged are guided to the sheet ejecting space 90 by the sheet pressing members 93 and 93 at the discharge position, the printing sheets 3000, 3000, . . . can be smoothly and reliably discharged to the discharge position.

Figure 47:
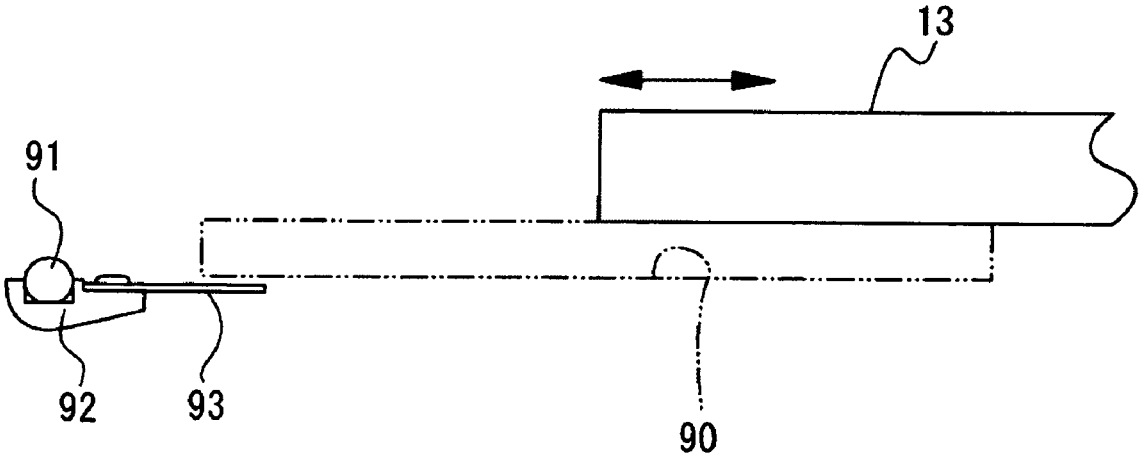
FIG. 47 is a plan view illustrating the withdrawal position of the sheet pressing members.

The sheet pressing members 93 and 93 are disposed at a position close to the storage tray 13 disposed in the slot 3*b*. When the storage tray 13 is disposed in the chassis 2 or when the storage tray 13 is pulled out of the slot 3*b*, the sheet pressing members 93 and 93 are maintained at a withdrawal position in which the sheet pressing members 93 and 93 are moved out of the traveling path of the storage tray 13 (refer to FIG. 47). The withdrawal position of the sheet pressing members 93 and 93 is, for example, a position in which the sheet pressing members 93 and 93 are parallel to the traveling path of the storage tray 13.

When the storage tray 13 is pulled out from the slot 3*b*, the sheet pressing members 93 and 93 are maintained in a position according to the detection results of a detection mechanism, not depicted in the drawings, for detecting whether or not the storage tray 13 is disposed in the slot 3*b*. When the storage tray 13 is disposed in the slot 3*b*, the sheet pressing members 93 and 93 are maintained at the discharge position, and when the storage tray 13 is inserted or pulled out, the sheet pressing members 93 and 93 are maintained at the withdrawal position.

Since when the storage tray 13 is inserted into the slot 3*b*, the sheet pressing members 93 and 93 are maintained at the withdrawal position in which the sheet pressing members 93 and 93 are moved out of the traveling path of the storage tray 13, the sheet pressing members 93 and 93 do not interfere with the storage tray 13 being inserted or pulled out. Thus, the storage tray 13 can be inserted or pulled out smoothly and without failure.

By composing the above-mentioned sheet pressing members 93 and 93 of a metal material, the electrical charge generated when pressing down the printing sheet 3000 can be neutralized.

The above-mentioned embodiment of the printer according to the present invention was a thermal head printer in which images are printed on a printing sheet by a thermal head through thermal transfer. The present invention is not limited to a thermal head printer. The present invention may be applied to various printers such as inkjet printers, dot impact printers, or laser printers.

The details of the shape and structure of the components for the above-mentioned embodiment are only one of many possible embodiments of the present invention. The above-mentioned embodiment does not pose any limitations to the technical field of the present invention.

INDUSTRIAL APPLICABILITY

The present invention may be applied to printers that print by thermal transfer or laser onto a printing sheet such as printing paper or printing film.

The invention claimed is:

1. A printer comprising:

a sheet storage unit for storing printing sheets, the sheet storage unit having a storage tray;

a pick-up unit for ejecting one of the printing sheets stored in the sheet storage unit at a time;

a delivery unit for delivering the printing sheet ejected from the pick-up unit;

a printing unit for printing an image on the printing sheet delivered from the delivery unit; and a sheet discharge unit for discharging the printing sheet sent from the printing unit, the units being disposed inside a chassis having a slot, wherein, the printer has a chassis and the chassis has slot within with the storage tray can be inserted, the storage tray comprises a sheet storage case for strong a plurality of printing sheets in a stack and having an opening on at least one side and a cover for covering the at least a portion of the opening on the sheet storage case, the cover comprises a cover body and an moveable member supported by the cover body so that the moveable member can freely open and close the opening on the sheet storage case, the moveable member being pivotally attached to the cover body and having locking protrusions extending from those portions pivotally attached to the cover body, the protrusions having a camming surface, the pick-up unit can eject one of the printing sheets at a time from the sheet storage case when the entire storage tray is disposed inside the slot of the chassis, the moveable member can be opened and closed and the printing sheet can be stored in or ejected from the sheet storage case when the storage tray is partly pulled out of the slot of the chassis, the sheet storage case has locking grooves on opposite parallel sides thereof in which the locking protrusion of the moveable member engages, each locking groove having a releasing engagement portion and a stopping engagement portion, the locking protrusions engage with the releasing engagement portions to lock the moveable member in a cover-open position when the moveable member is opened, the locking protrusions engage with the stopping engagement portions to lock the moveable member in a cover-closed position when the moveable members are closed, and the locking protrusions being configured to slide on their camming surfaces between the stopping engagement portions and the releasing engagement portions.

* * * * *